US012643701B2

(12) United States Patent
Takidis et al.

(10) Patent No.: US 12,643,701 B2
(45) Date of Patent: Jun. 2, 2026

(54) STRAP-FEEDING ASSEMBLY WITH STRAP-SIZE-ADJUSTMENT FEATURES

(71) Applicant: Signode Industrial Group LLC, Tampa, FL (US)

(72) Inventors: Dimitrios Takidis, Dübendorf (CH); Philipp Buser, Erlinsbach (CH); Christian Benz, Zürich (CH); Michael Meng, Gipf-Oberfrick (CH)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 19/068,239

(22) Filed: Mar. 3, 2025

(65) Prior Publication Data

US 2025/0197047 A1 Jun. 19, 2025

Related U.S. Application Data

(63) Continuation of application No. 18/253,139, filed as application No. PCT/US2021/072146 on Nov. 1, 2021, now Pat. No. 12,240,645.

(60) Provisional application No. 63/166,666, filed on Mar. 26, 2021, provisional application No. 63/114,777, filed on Nov. 17, 2020.

(51) Int. Cl.

| | |
|---|---|
| ***B65B 59/00*** | (2006.01) |
| ***B65B 13/06*** | (2006.01) |
| ***B65B 13/18*** | (2006.01) |
| ***B65B 59/04*** | (2006.01) |

(52) U.S. Cl.

CPC ..... *B65B 59/003* (2019.05); *B65B 13/06* (2013.01); *B65B 13/18* (2013.01); *B65B 59/04* (2013.01)

(58) Field of Classification Search

CPC ..... B65B 13/06; B65B 59/003; B65B 59/04; B65B 13/18; B65B 59/005; B65B 13/185; B65B 13/22; B65B 13/24; B65B 59/02; B65B 65/02

USPC ..... 53/589

See application file for complete search history.

(56) References Cited

U.S. PATENT DOCUMENTS

| | | | | |
|---|---|---|---|---|
| 3,322,602 | A | 5/1967 | Rudolf | |
| 4,383,881 | A | 5/1983 | Sakaki | |
| 4,502,911 | A | 3/1985 | Discavage | |
| 4,536,248 | A | 8/1985 | Bullington et al. | |
| 4,683,017 | A * | 7/1987 | Figiel | B65B 13/02 156/157 |

(Continued)

FOREIGN PATENT DOCUMENTS

| | | | |
|---|---|---|---|
| CA | 2467257 A1 | 12/2004 | |
| EP | 0779213 A1 * | 6/1997 | B65B 59/04 |

(Continued)

OTHER PUBLICATIONS

"International Search Report and Written Opinion", from PCT/US2021/072146, Jun. 1, 2022.

(Continued)

*Primary Examiner* — Jacob A Smith

(74) *Attorney, Agent, or Firm* — Neal, Gerber & Eisenberg LLP

(57) ABSTRACT

Various embodiments of the present disclosure provide a strapping machine strap-feeding assembly with features that enable adjustment of the strap-feeding assembly to accommodate different strap sizes.

16 Claims, 34 Drawing Sheets

(56) References Cited

U.S. PATENT DOCUMENTS

| | | | | |
|---|---|---|---|---|
| 4,845,928 | A * | 7/1989 | Sakaki | B65B 41/12 53/589 |
| 5,746,882 | A | 5/1998 | Bell et al. | |
| 6,041,698 | A | 3/2000 | Chin-chang et al. | |
| 6,584,892 | B2 | 7/2003 | Flaum et al. | |
| 6,598,379 | B2 | 7/2003 | Zitella et al. | |
| 6,604,339 | B2 | 8/2003 | Zitella et al. | |
| 6,629,398 | B2 | 10/2003 | Pearson et al. | |
| 6,857,252 | B2 | 2/2005 | Haberstroh et al. | |
| 6,871,584 | B2 | 3/2005 | Pearson | |
| 6,935,227 | B2 | 8/2005 | Lopez et al. | |
| 6,955,119 | B2 | 10/2005 | Bobren et al. | |
| 7,270,055 | B1 | 9/2007 | Haberstroh et al. | |
| 7,287,464 | B1 | 10/2007 | Kirar et al. | |
| 7,377,213 | B1 | 5/2008 | Haberstroh et al. | |
| 7,428,867 | B1 | 9/2008 | Bell, Jr. | |
| 7,454,877 | B2 | 11/2008 | Morrison | |
| 7,798,060 | B2 | 9/2010 | Pearson et al. | |
| 7,861,649 | B2 * | 1/2011 | Bobren | B65B 13/06 53/589 |
| 8,281,711 | B2 | 10/2012 | Haberstroh et al. | |
| 8,607,695 | B2 | 12/2013 | Schwede | |
| 8,689,684 | B2 | 4/2014 | Haberstroh et al. | |
| 8,701,555 | B2 | 4/2014 | Bell, Jr. | |
| 8,720,326 | B2 | 5/2014 | Elliott et al. | |
| 9,296,501 | B2 | 3/2016 | Haberstroh et al. | |
| 10,351,275 | B2 | 7/2019 | Elliott | |
| 10,513,358 | B2 | 12/2019 | Takidis et al. | |
| 10,633,130 | B2 | 4/2020 | Haberstroh et al. | |
| 11,440,689 | B2 | 9/2022 | Foy et al. | |
| 11,597,546 | B2 | 3/2023 | Höhn et al. | |

FOREIGN PATENT DOCUMENTS

| | | | |
|---|---|---|---|
| EP | 0779213 | B1 | 4/1999 |
| GB | 775111 | A | 5/1957 |
| JP | H07300107 | A | 11/1995 |
| JP | H08282614 | A | 10/1996 |
| KR | 20010036788 | A | 5/2001 |

OTHER PUBLICATIONS

Chinese First Office Action and Search Report, from corresponding Chinese Patent Application No. 202180077196.2 with English translation, Jan. 14, 2026.

* cited by examiner

STRAP-FEEDING ASSEMBLY WITH STRAP-SIZE-ADJUSTMENT FEATURES

PRIORITY CLAIM

This application is a continuation of, claims priority to and the benefit of U.S. patent application Ser. No. 18/253,139, filed as a 371 (c) patent application on May 16, 2023, which application is a national phase application of PCT/US2021/072146, filed on Nov. 1, 2021, which claims priority to and the benefit of U.S. Provisional Patent Application No. 63/114,777, filed Nov. 17, 2020, and U.S. Provisional Patent Application No. 63/166,666, filed Mar. 26, 2021, the entire contents of each of which is incorporated herein by reference.

FIELD

The present disclosure relates to strapping machines, and more particularly to strapping machine strap-feeding assemblies with features that enable adjustment of the strap-feeding assemblies for use with different strap sizes.

BACKGROUND

A strapping machine forms a tensioned loop of plastic strap (such as polyester or polypropylene strap) or metal strap (such as steel strap) around a load. A typical strapping machine includes a support surface that supports the load, a strap chute that circumscribes the support surface, a strapping head that forms the strap loop, a controller that controls the strapping head to strap the load, and a frame that supports these components. A typical strapping head includes a strap-feeding assembly for feeding strap from a strap supply into and around the strap chute and for retracting the strap so it exits the strap chute and moves radially inwardly into contact with the load, a strap-tensioning assembly for tensioning the strap around the load, and a strap-sealing assembly for cutting the strap from the strap supply and attaching two areas of the strap together to form the strap loop. Each of these assemblies includes a guide that defines a strap channel that the strap passes through as it moves through the assembly. The strap channels and the strap chute together define a strap path that the strap moves through.

To strap the load, the strap-feeding assembly feeds strap (leading strap end first) from the strap supply through the strap-tensioning assembly, through the strap-sealing assembly, and into and around the strap chute until the leading strap end returns to the strap-sealing assembly. While the strap-sealing assembly holds the leading strap end, the strap-feeding assembly retracts the strap to pull the strap out of the strap chute and onto and around the load. The strap-tensioning assembly then tensions the strap to a designated strap tension. The strap-sealing assembly cuts the strap from the strap supply to form a trailing strap end and attaches the leading and trailing strap ends to one another, thereby forming a tensioned strap loop around the load.

Different applications require strap of different sizes. For instance, strap that is 8 millimeters wide and 0.3 millimeters thick may be used for light-duty applications, while strap that is 16 millimeters wide and 0.85 millimeters thick may be used for heavy-duty applications. Certain known strapping machines are configured so they can operate with strap of different widths and thicknesses. The strap-feeding assemblies (and in some cases the strap-tensioning and/or strap-sealing assemblies) of these strapping machines have guide members that define fixed-width and fixed-thickness strap channels that are sized to accommodate the widest and thickest strap used with those strapping machines. These fixed-width and fixed-thickness strap channels become problematic when smaller-width and/or thinner strap is used. Specifically, since there is more empty space in the strap channels when smaller-width and/or thinner strap is used, the strap tends to "wander" laterally and/or vertically in the strap channel and can snag and become stuck in the strap channel. This results in a strap mis-feed and requires the strap-feeding assembly to retract the strap and re-feed it, which results in unwanted downtime. It could also damage the leading end of the strap, leading to material waste or (if not recognized) sub-optimal welds.

SUMMARY

Various embodiments of the present disclosure provide a strapping machine strap-feeding assembly with features that enable adjustment of the strap-feeding assembly to accommodate different strap sizes.

Various embodiments of the strap-feeding assembly comprise a strap-feeding-assembly frame, a strap-driving assembly supported by the strap-feeding-assembly frame and comprising a feed wheel and an actuator operably connected to the feed wheel to drive the feed wheel, and a strap-guiding assembly supported by the strap-feeding-assembly frame. The strap-guiding assembly comprises a strap-guiding-assembly frame; a guide member mounted to the strap-guiding-assembly frame and at least partially defining a strap channel having an adjustable strap-channel width, the guide member movable relative to the strap-guiding-assembly frame frame between a first position corresponding to a first strap-channel width and a second position corresponding to a second strap-channel width different from the first strap-channel width; and a strap-channel-width adjuster operably connected to the guide member to move the guide member from its first position to its second position.

Other embodiments of the strap-feeding assembly comprise a strap-feeding-assembly frame, a strap-driving assembly supported by the strap-feeding-assembly frame and comprising a feed wheel and an actuator operably connected to the feed wheel to drive the feed wheel, a first strap-guiding assembly supported by the strap-feeding-assembly frame and including one or more guide members partially defining a strap channel, and a second strap-guiding assembly supported by the strap-feeding-assembly frame. The second strap-guiding assembly comprises a housing; and a counter-roller assembly comprising: a support mounted to the housing; a counter roller mounted to the support and rotatable relative to the support; and a height adjuster operably connected to the counter roller to move the counter roller from a first position in which a first distance separates the counter roller and the feed wheel to a second position in which a second distance separates the counter roller and the feed wheel, wherein the second distance is greater than the first distance.

Other embodiments of the strap-feeding assembly comprise a strap-feeding-assembly frame comprising first and second strap-guiding-assembly mounts; and a strap-guiding assembly removably mountable to the strap-feeding-assembly frame and comprising: a strap-guiding-assembly frame defining a mounting opening sized to receive the first strap-guiding-assembly mount and comprising a strap-guiding-assembly retainer; and a guide member mounted to the strap-guiding-assembly frame and at least partially defining a strap channel, wherein the first and second strap-guiding-assembly mounts are positioned such that the strap-guiding assembly is mounted to the strap-feeding-assembly frame and in an operational position when: (1) the first strap-guiding-assembly mount is received in the mounting opening of the strap-guiding-assembly frame; and (2) the strap-guiding-assembly retainer lockingly engages the second strap-guiding-assembly mount.

BRIEF DESCRIPTION OF THE FIGURES

FIGS. 12A and 12C are cross-sectional side views taken along line 12A-12A of FIG. 9A.

DETAILED DESCRIPTION

Figure 1:
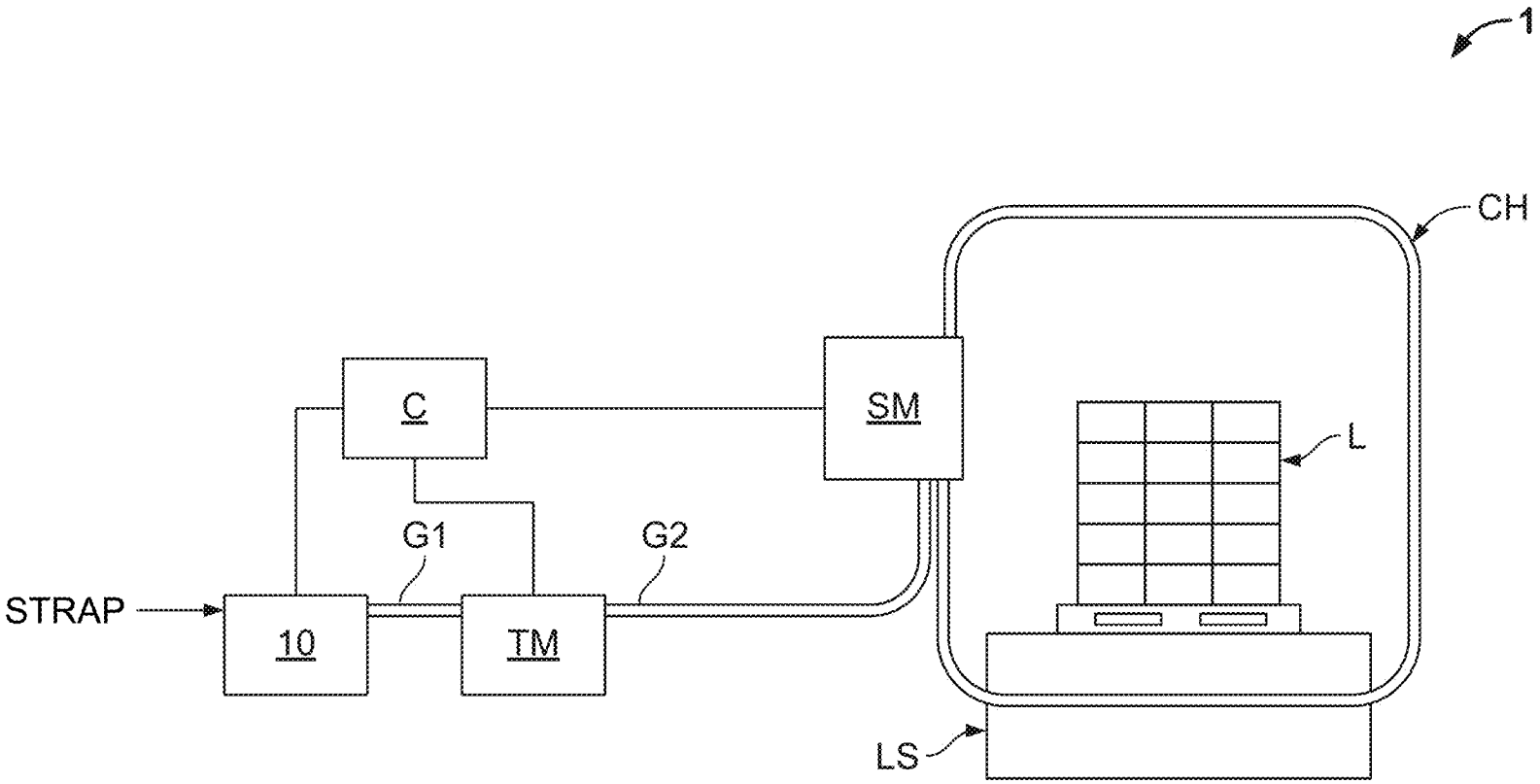
FIG. 1 is a diagrammatic view of a strapping machine of the present disclosure.
Figure 2:
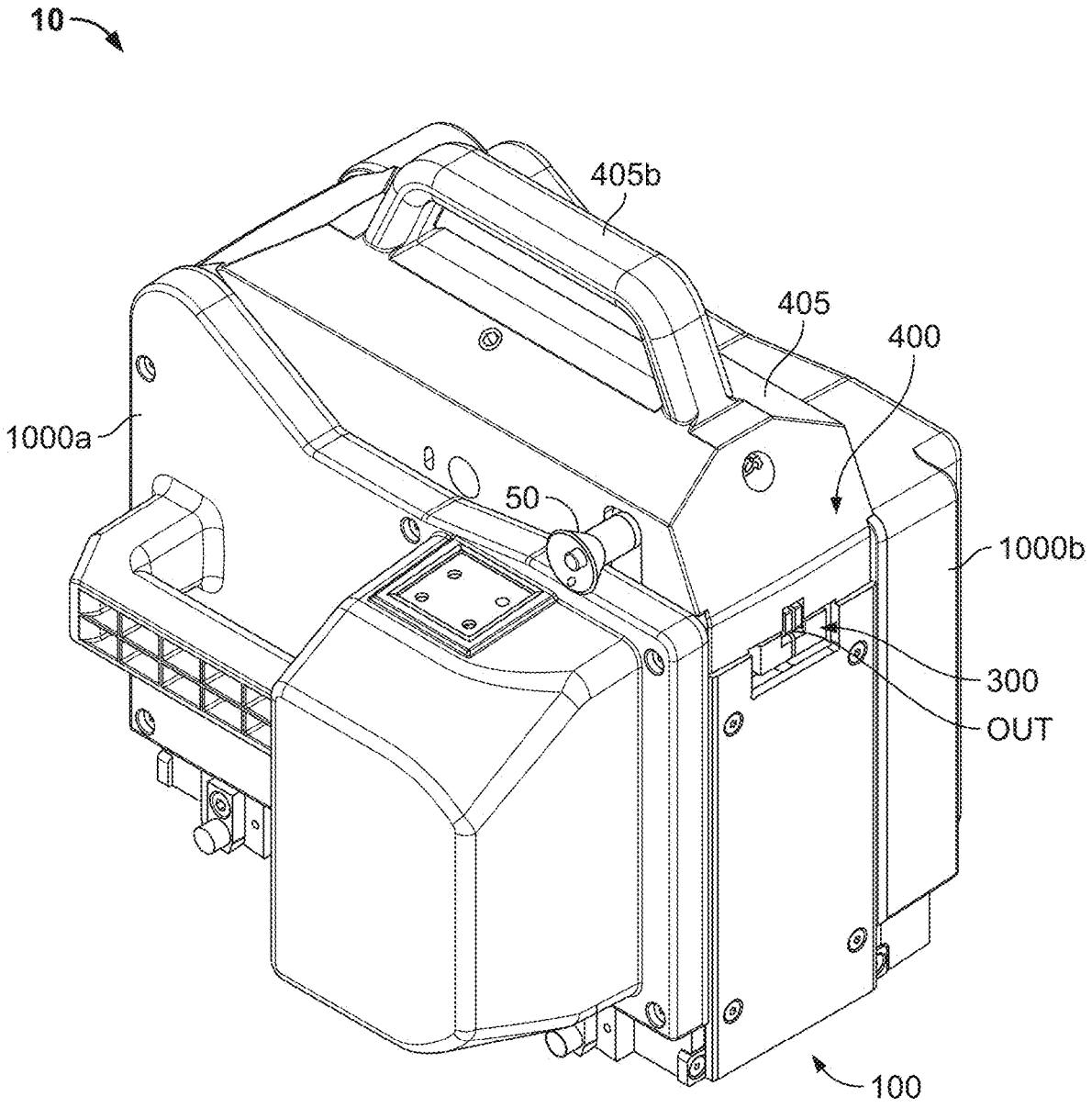
FIG. 2 is a perspective view of one example embodiment of a strap-feeding assembly of the strapping machine of FIG. 1 with its upper strap-guiding assembly in its closed position.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIG. 1 shows one embodiment of a strapping machine 1 of the present disclosure and components thereof in a simplified manner for clarity. The strapping machine 1 is configured to form a tensioned loop of strap around a load, and includes a strapping-machine frame (not shown), a strap chute CH, a load supporter LS, a strap-feeding assembly 10, a strap-tensioning assembly TM, a strap-sealing assembly SM, guides G1 and G2, and a controller C The strapping-machine frame is configured to support some (or all) of the other components of the strapping machine 1 and may be formed of any suitable components arranged in any suitable configuration. The load supporter LS is configured to support loads—such as the palletized load L—as they are strapped by and as they move through the strapping machine 1. The load supporter LS includes a support surface (not labeled) on which loads are positioned during strapping and over which loads move as they move through the strapping machine 1. In this example embodiment, the support surface includes multiple rollers that facilitate movement of the loads through the strapping machine 1. The rollers may be driven or undriven. In other embodiments, the support surface includes a driven conveyor instead of rollers.

The strap chute CH circumscribes the support surface of the load supporter LS and defines a strap path that the strap follows when fed through the strap chute CH and from which the strap is removed when retracted. The strap chute CH includes two spaced-apart first and second upstanding legs (not labeled), an upper connecting portion (not labeled) that spans the first and second legs, a lower connecting portion (not labeled) that spans the first and second legs and is positioned in the load supporter LS, and elbows (not labeled) that connect these portions. As is known in the art, the radially inward wall of the strap chute CH is formed from multiple overlapping gates that are spring biased to a closed position that enables the strap to traverse the strap path when fed through the strap chute CH. When the strap-feeding assembly 10 exerts a pulling force on the strap to retract the strap, the pulling force overcomes the biasing force of the springs and causes the gates to pivot to an open position, thereby releasing the strap from the strap chute CH so the strap moves radially inward into contact with the load L.

The strap-feeding assembly 10, the strap-tensioning assembly TM, and the strap-scaling assembly SM are together configured to form a tensioned strap loop around the load by feeding the strap through the strap chute CH, holding the leading strap end while retracting the strap to remove it from the strap chute CH so it contacts the load L, tensioning the strap around the load L to a designated tension, cutting the strap from the strap supply to form a trailing strap end, and connecting the leading strap end and the trailing strap end to one another. In this example embodiment, the strap-feeding assembly 10, the strap-tensioning assembly TM, and the strap-sealing assembly SM are distinct modules that are individually attachable to and removable from the strapping-machine frame. The guide G1 extends between the strap-feeding and strap-tensioning assemblies 10 and TM and is configured to guide the strap as it moves between those assemblies. Similarly, the guide G2 extends between the strap-tensioning and strap-scaling assembly TM and SM and is configured to guide the strap as it moves between those assemblies. In other embodiments, these assemblies form a strapping head that is not comprised of self-contained and individually removable modules.

Generally, the strap-feeding assembly 10 feeds strap from a strap supply (not shown) and into and around the strap chute CH and retracts the strap so it exits the strap chute CH and contacts the load L. The strap-feeding assembly 10 is described in more detail below with respect to FIGS. 2-14D.

The strap-tensioning assembly TM is configured to tension the strap around the load L. Briefly, the strap-tensioning assembly includes a tensioning wheel driven by a tension actuator. Once the strap-feeding assembly 10 retracts the strap so it contacts the load L, the tension actuator drives the tensioning wheel to tension the strap to a designated (typically preset) tension.

The strap-sealing assembly SM is configured to, after the strap-tensioning assembly TM tensions the strap to the designated tension, cut the strap from the strap supply and form the strap loop. The manner of attaching the leading and trailing strap ends to one another depends on the type of strapping machine and the type of strap. Certain strapping machines configured for plastic strap include a strap-scaling assembly with a friction welder, a heated blade, or an ultrasonic welder configured to attach the leading and trailing strap ends to one another. Some strapping machines configured for plastic strap or metal strap include a strap-sealing assembly with jaws that mechanically deform (referred to as "crimping" in the industry) or cut notches into (referred to as "notching" in the industry) a seal element positioned around the leading and trailing strap ends to attach them to one another. Other strapping machines configured for metal strap include a strap-sealing assembly with punches and dies configured to form a set of mechanically interlocking cuts in the leading and trailing strap ends to attach them to one another (referred to in the strapping industry as a "sealless" attachment). Still other strapping machines configured for metal strap include a strap-scaling assembly with spot, inert-gas, or other welders configured to weld the leading and trailing strap ends to one another.

The controller C includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 1. In certain embodiments, the strapping machine includes a single controller, while in other embodiments the strapping machine 1 has multiple controllers that operate together. In certain embodiments, the controller C is part of the strap-feeding assembly 10, the strap-tensioning assembly TM, and/or the strap-scaling assembly SM.

Returning to the strap-feeding assembly 10, the strap-feeding assembly 10 feeds strap from a strap supply (not shown) and into and around the strap chute CH and retracts the strap so it exits the strap chute CH and contacts the load L. The strap-feeding assembly 10 includes features that enable the strap-feeding assembly 10 to be adjusted to accommodate different strap sizes (e.g., different strap widths and thicknesses). FIGS. 2-14D show one embodiment of the strap-feeding assembly 10 and components thereof. The strap-feeding assembly 10 includes a strap-feeding-assembly frame 100, a strap-driving assembly 200, a lower (first) strap-guiding assembly 300, and an upper (second) strap-guiding assembly 400.

Figure 5A:
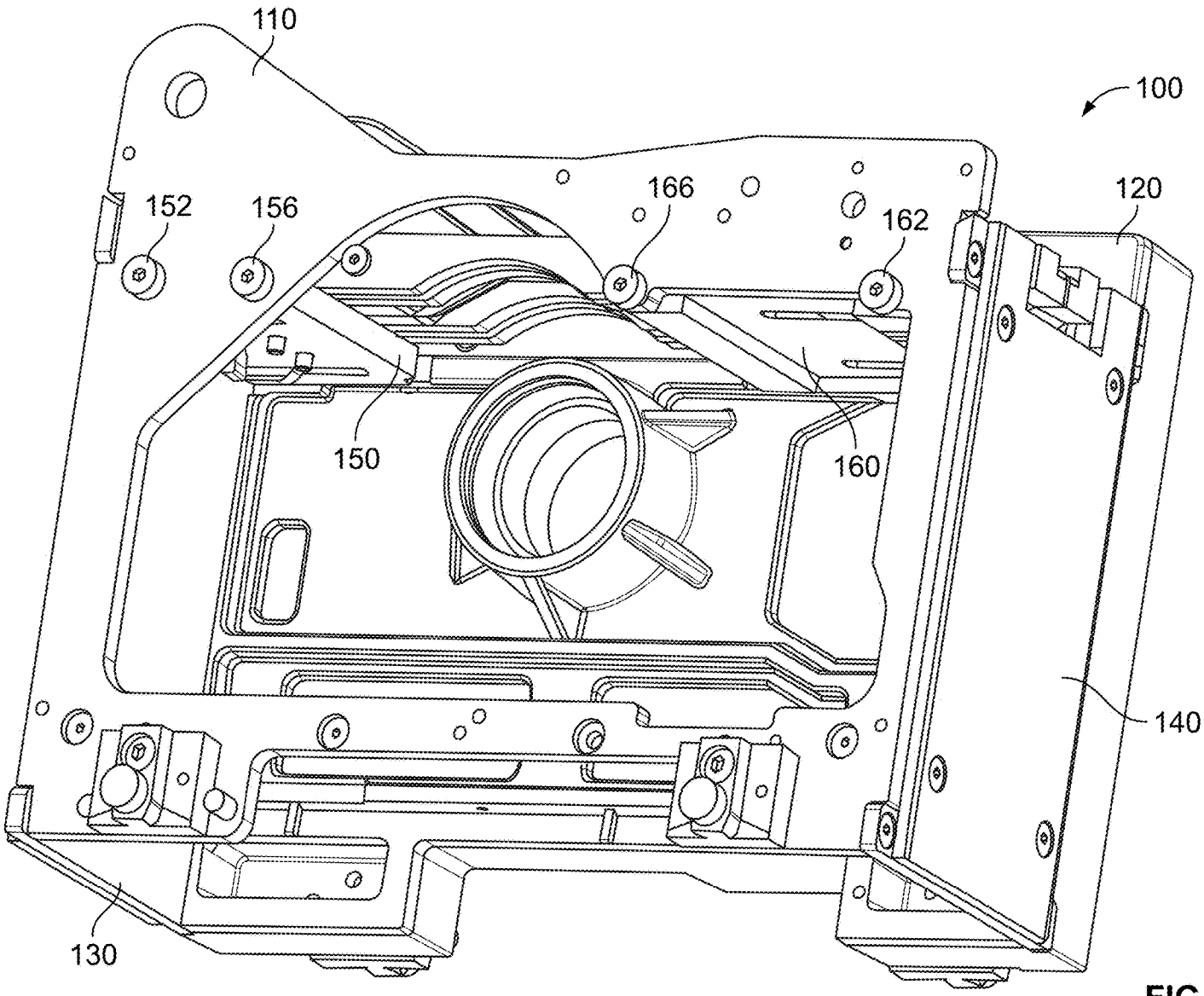
FIGS. 5A and 5B are front and rear perspective views of the strap-feeding-assembly frame of the strap-feeding assembly of FIG. 2.
Figure 5B:
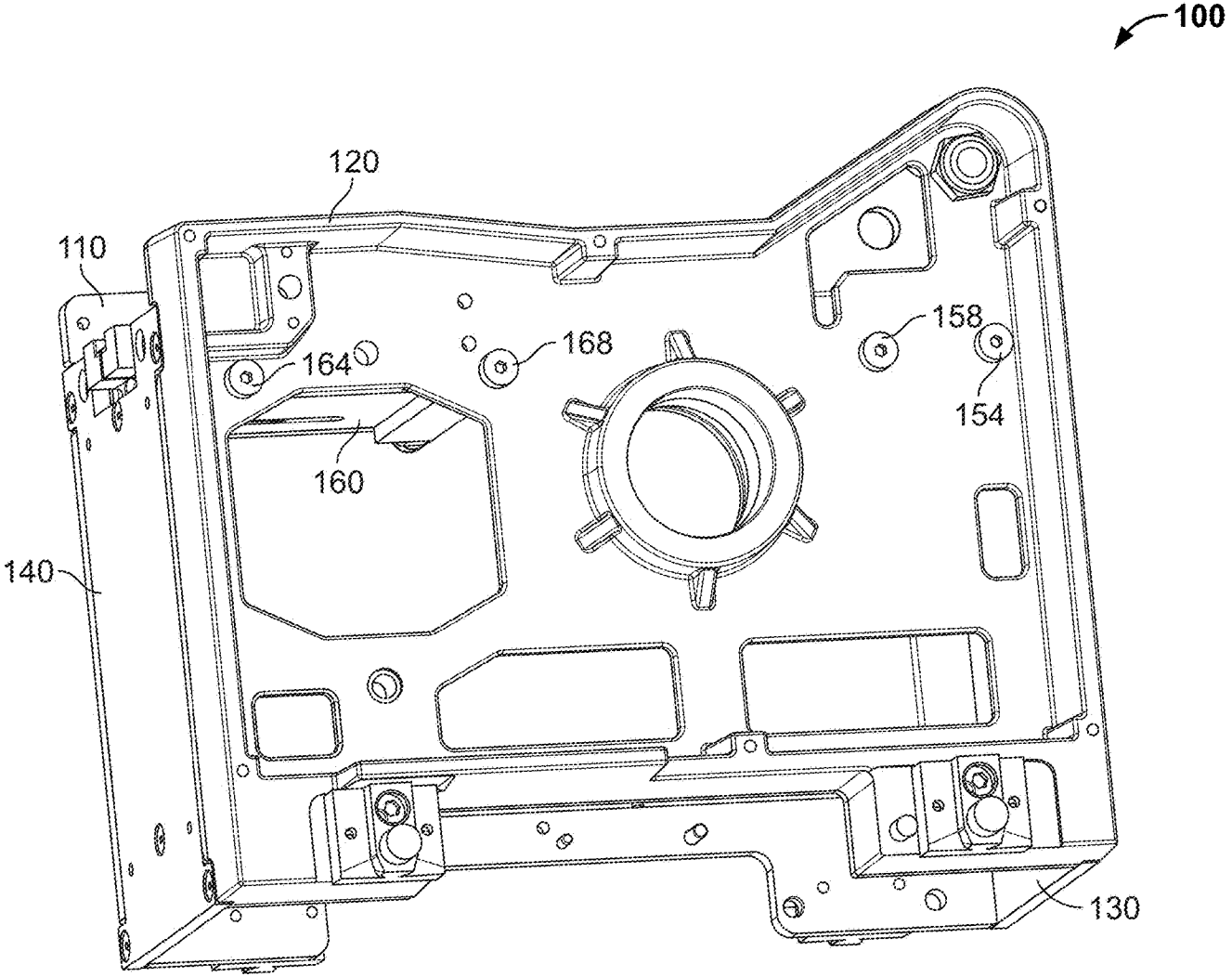

The strap-feeding-assembly frame 100, which is best shown in FIGS. 5A and 5B, directly or indirectly supports the other components of the strap-feeding assembly 10 and may be formed of any suitable components arranged in any suitable configuration. In this example embodiment, the strap-feeding-assembly frame 100 includes front (first), back (second), infeed side (third), and outfeed side (fourth) frame members 110, 120, 130, and 140; first and second support members 150 and 160; first-support-member mounting elements 152, 154, 156, and 158; and second-support-member mounting elements 162, 164, 166, and 168.

The front and back frame members 110 and 120 are spaced-apart from one another, and the infeed side and outfeed side frame members 130 and 140 are spaced-apart from one another. The infeed side frame member 130 extends between one end of the front frame member 110 and one end of the back frame member 120, and the outfeed side frame member 140 extends between the other end of the front frame member 110 and the other end of the back frame member 120. The first support member 150 extends between the front and back frame members 110 and 120 adjacent the infeed side frame member 130 and is mounted to the front and back frame members 110 and 120 via the first-support-member mounting elements 152, 154, 156, and 158, which are pins in this example embodiment but may be any other suitable components (such as threaded fasteners). The second support member 160 extends between the front and back frame members 110 and 120 adjacent the outfeed side frame member 140 and is mounted to the front and back frame members 110 and 120 via the second-support-member mounting elements 162, 164, 166, and 168, which are pins in this example embodiment but may be any other suitable components (such as threaded fasteners).

Two covers 1000*a* and 1000*b* are removably attached to the strap-feeding-assembly frame 100 to at least partially enclose certain components of the strap-driving assembly 200 and the lower strap-guiding assembly 300.

Figure 4:
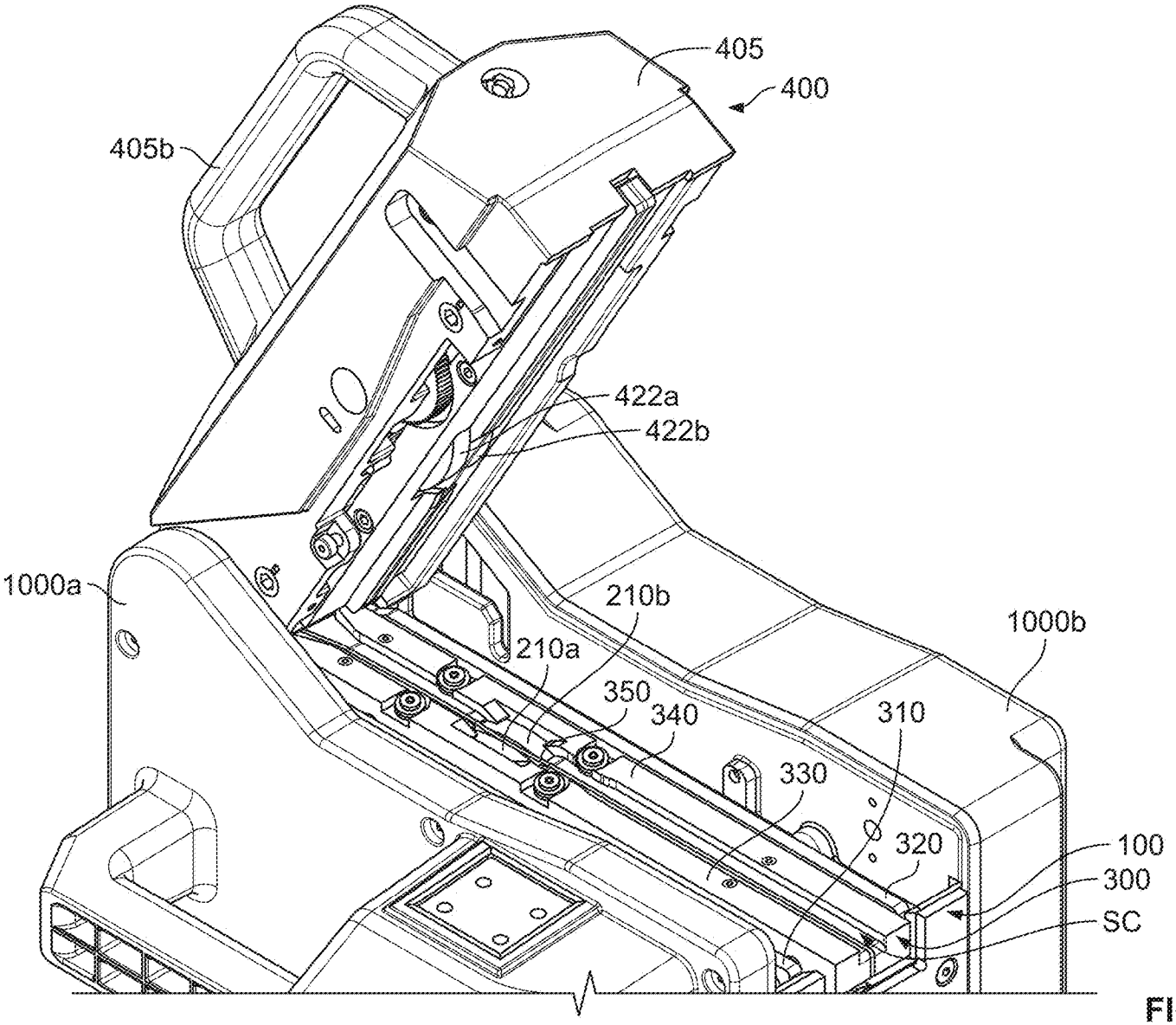
FIG. 4 is another perspective view of the strap-feeding assembly of FIG. 2 with its upper strap-guiding assembly in its open position and with certain components removed for clarity.
Figure 6A:
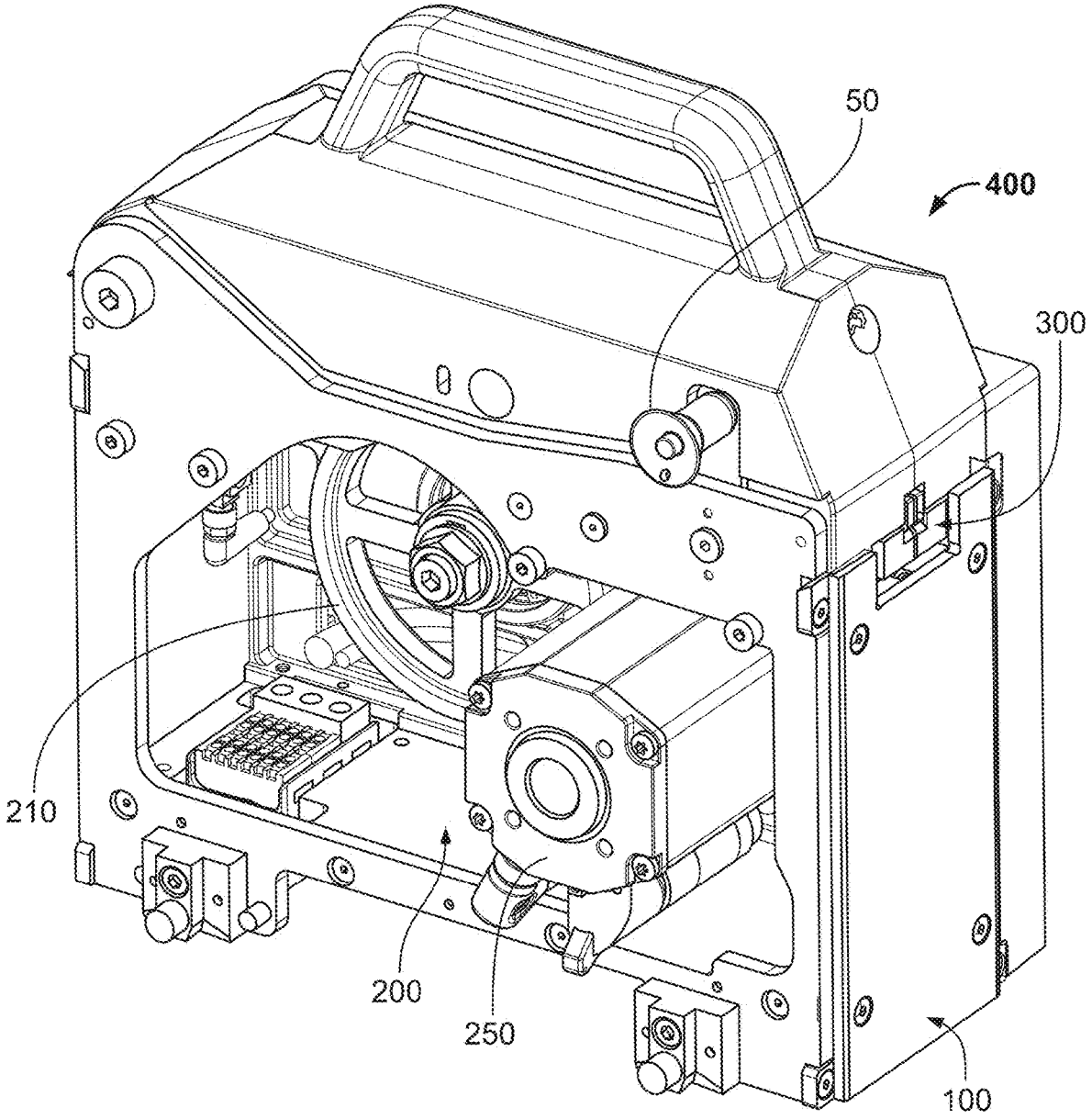
FIGS. 6A and 6B are opposing perspective views of the strap-feeding assembly of FIG. 2 with its covers removed to expose the strap-driving assembly and with its upper strap-guiding assembly in its closed position.
Figure 6B:
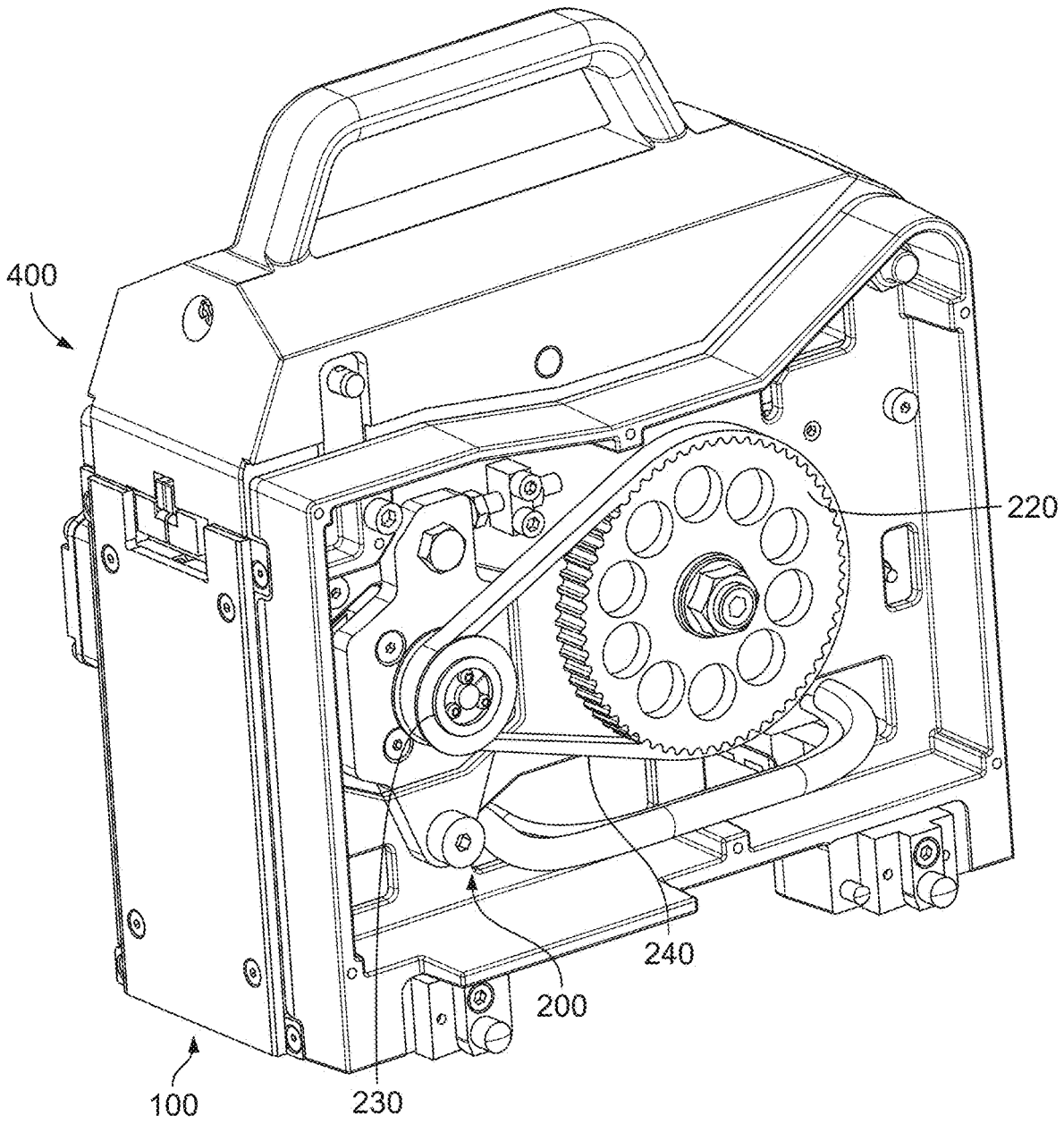

The strap-driving assembly 200, which is best shown in FIGS. 4, 6A, and 6B, engages the strap and, with the help of the upper strap-guiding assembly 400, feeds the strap to and retracts the strap from the strap chute CH. The strap-driving assembly 200 includes a feed wheel 210 having spaced-apart, circumferential strap-engaging surfaces 210*a* and 210*b* (FIG. 4), a driven gear 220, a drive gear 230, a drive belt 240, and an actuator 250. The feed wheel 210 and the driven gear 220 are both fixedly connected (such as via a keyed, splined, or other suitable connection) to a common drive shaft (not shown) that is, in turn, mounted to the strap-feeding-assembly frame 100 via one or more bearings (not shown). This enables the drive shaft, the feed wheel 210, and the driven gear 220 to rotate together relative to the strap-feeding-assembly frame 100 and the lower and upper strap-guiding assemblies 300 and 400. The actuator 250 (here an electric motor though any suitable actuator may be used) is mounted to the strap-feeding-assembly frame 100. The actuator 250 has an output shaft (not labeled) to which the drive gear 230 is fixedly mounted (such as via a keyed, splined, or other suitable connection) such that the output shaft and the drive gear 230 rotate together relative to the strap-feeding-assembly frame 100. The drive belt 240, which is a toothed belt in this example embodiment, operably connects the drive gear 230 and the driven gear 220. When the actuator 250 rotates its output shaft, the drive gear 230 rotates. The drive belt 240 transfers this rotation to the driven gear 220, which begins rotating and (via the drive shaft) causes the feed wheel 210 to rotate. Accordingly, the actuator 250 is operably connected to the feed wheel 210 (via the drive gear 230, the drive belt 240, and the driven gear 220, or via any suitable transmission components in other embodiments) to rotate the feed wheel 210.

Figure 7A:
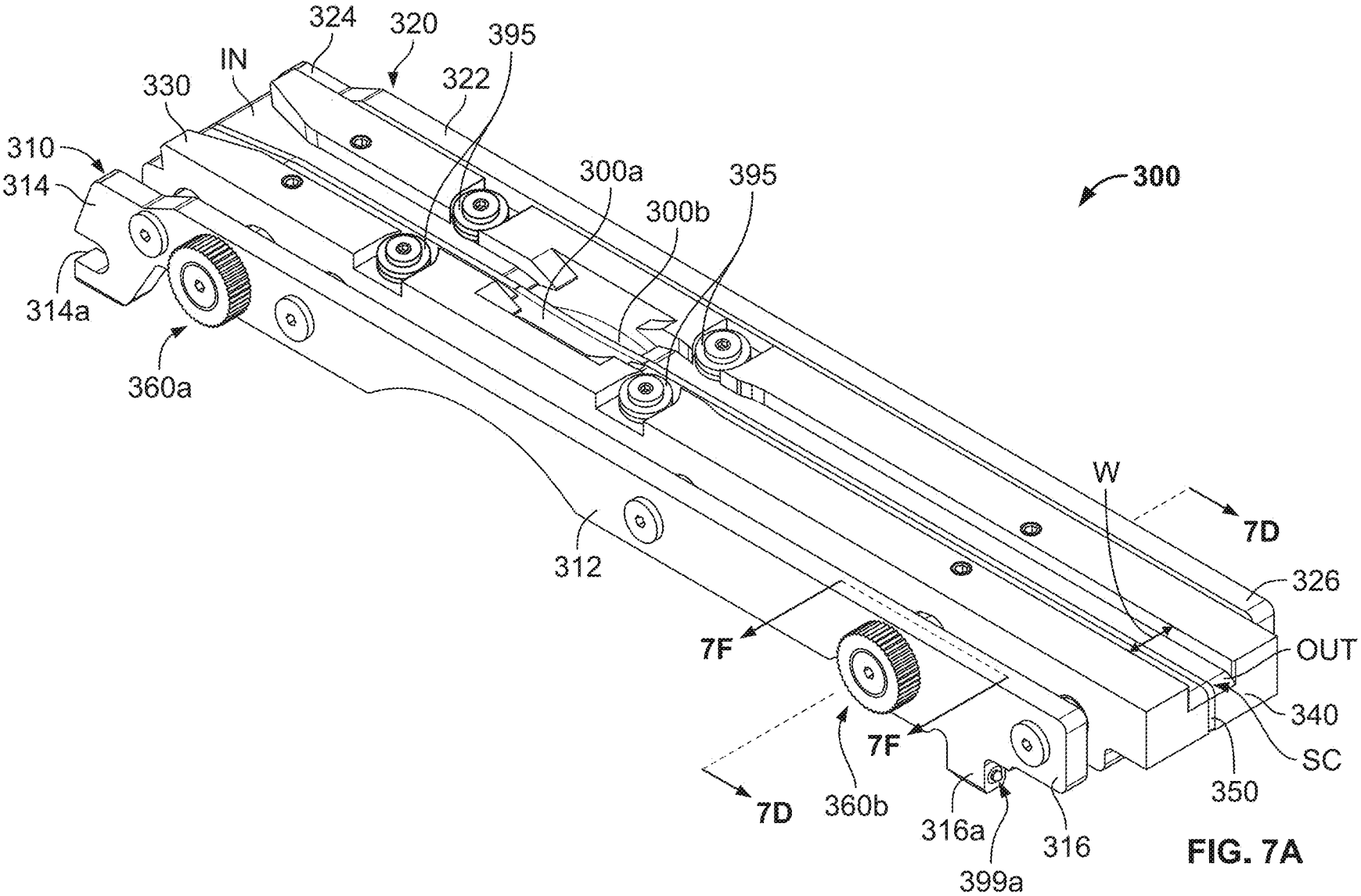
FIG. 7A is a perspective view of the lower strap-guiding assembly of the strap-feeding assembly of FIG. 2.
Figure 7B:
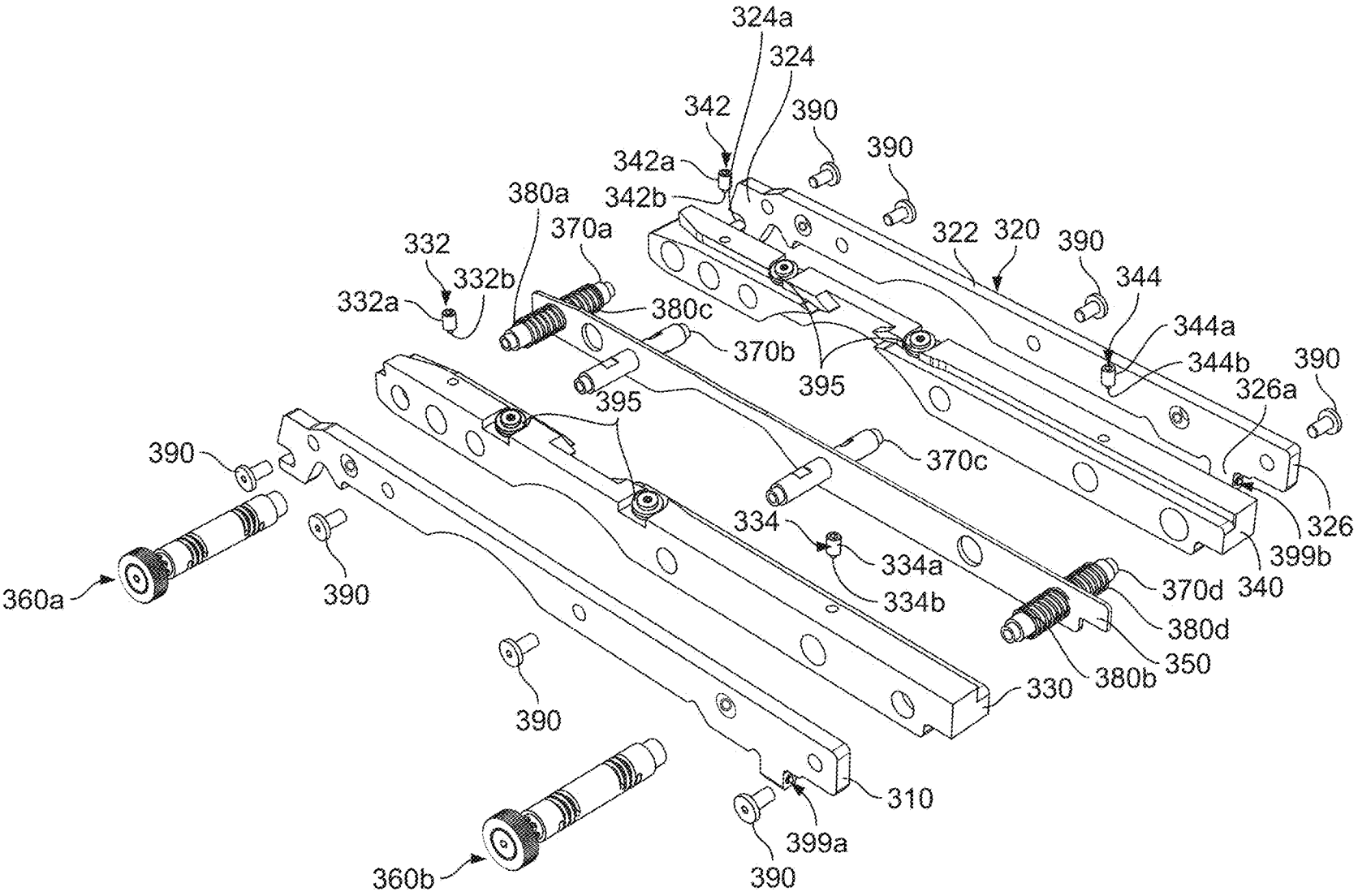
FIG. 7B is an exploded perspective view of the lower strap-guiding assembly of FIG. 7A.

The lower strap-guiding assembly 300, which is best shown in FIGS. 4 and 7A-7F, guides the strap through the strap-feeding assembly 10 (along with the upper strap-guiding assembly 400) and is adjustable to accommodate different strap widths. As best shown in FIG. 7B, the lower strap-guiding assembly 300 includes: first and second guide frame members 310 and 320; first and second outer guide members 330 and 340; first, second, third, and fourth outer-guide-member directors 332, 334, 342, and 344; a center guide member 350; first and second strap-channel-width adjusters 360*a* and 360*b*; first second, third, and fourth spacers 370*a*, 370*b*, 370*c*, and 370*d*; first second, third, and fourth biasing elements 380*a*, 380*b*, 380*c*, and 380*d*; multiple fasteners 390; multiple guide rollers 395; multiple strap-channel-width-adjuster retainers 398; and multiple lower-strap-guiding-assembly retainers 399.

The first guide frame member 310 includes a body 312 having a first (infeed) end 314 and a second (outfeed) end 316. A mounting opening 314*a* is defined in the first (infeed) end 314. The second (outfeed) end 316 includes a foot 316*a* that includes the lower-strap-guiding-assembly retainer 399*a*. The second guide frame member 320 includes a body 322 having a first (infeed) end 324 and a second (outfeed) end 326. A mounting opening 324*a* is defined in the first (infeed) end 324. The second (outfeed) end 326 includes a foot 326*a* that includes the lower-strap-guiding-assembly retainer 399*b*. In other embodiments (not shown), the mounting openings are defined at the second (outfeed) ends of the first and second guide frame members, and the lower-strap-guiding-assembly retainers are included in the first (infeed) ends of the first and second guide frame members.

Figure 7C:
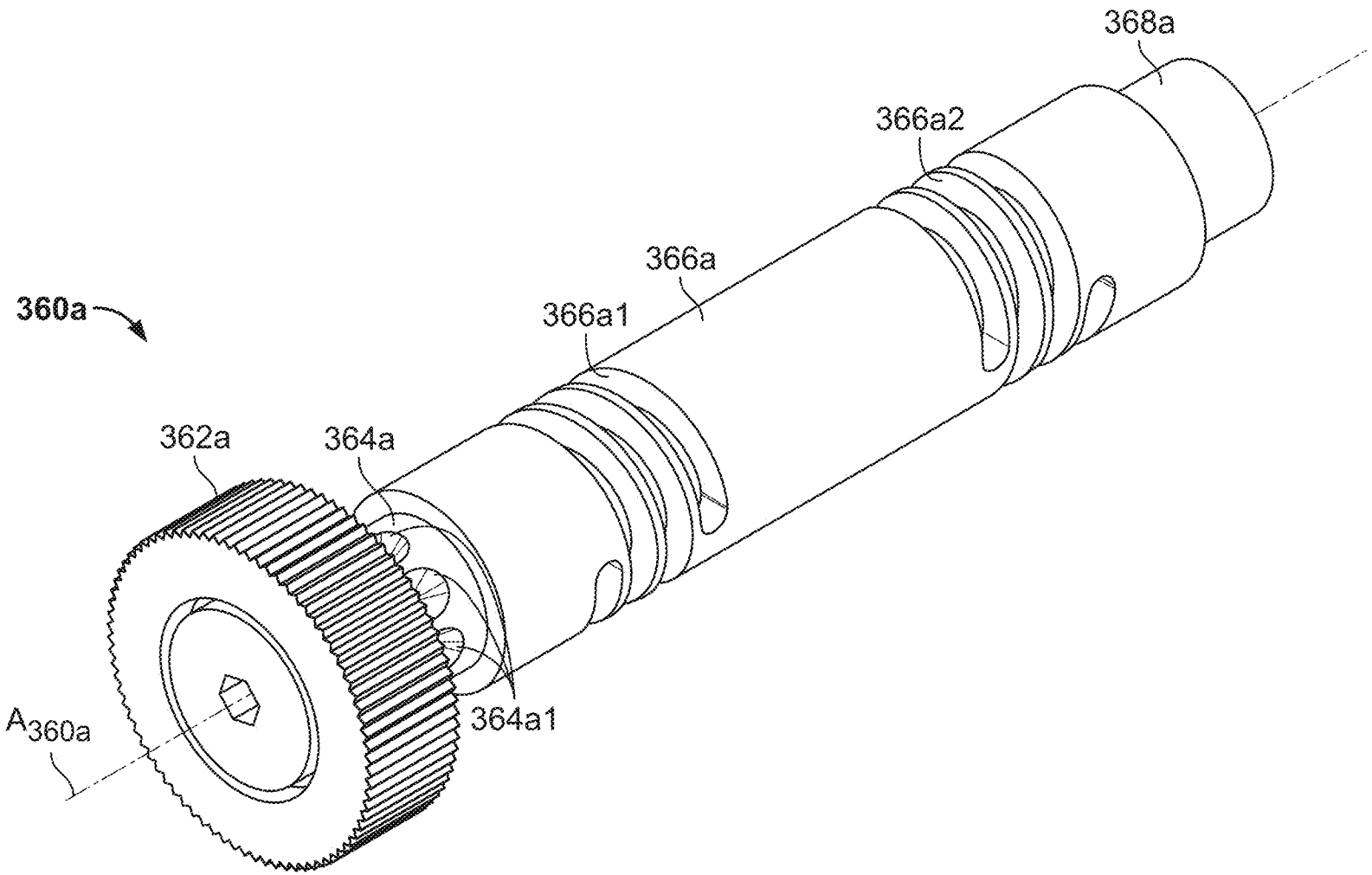
FIG. 7C is a perspective view of the strap-channel-width adjuster of the lower strap-guiding assembly of FIG. 7A.
Figure 7D:
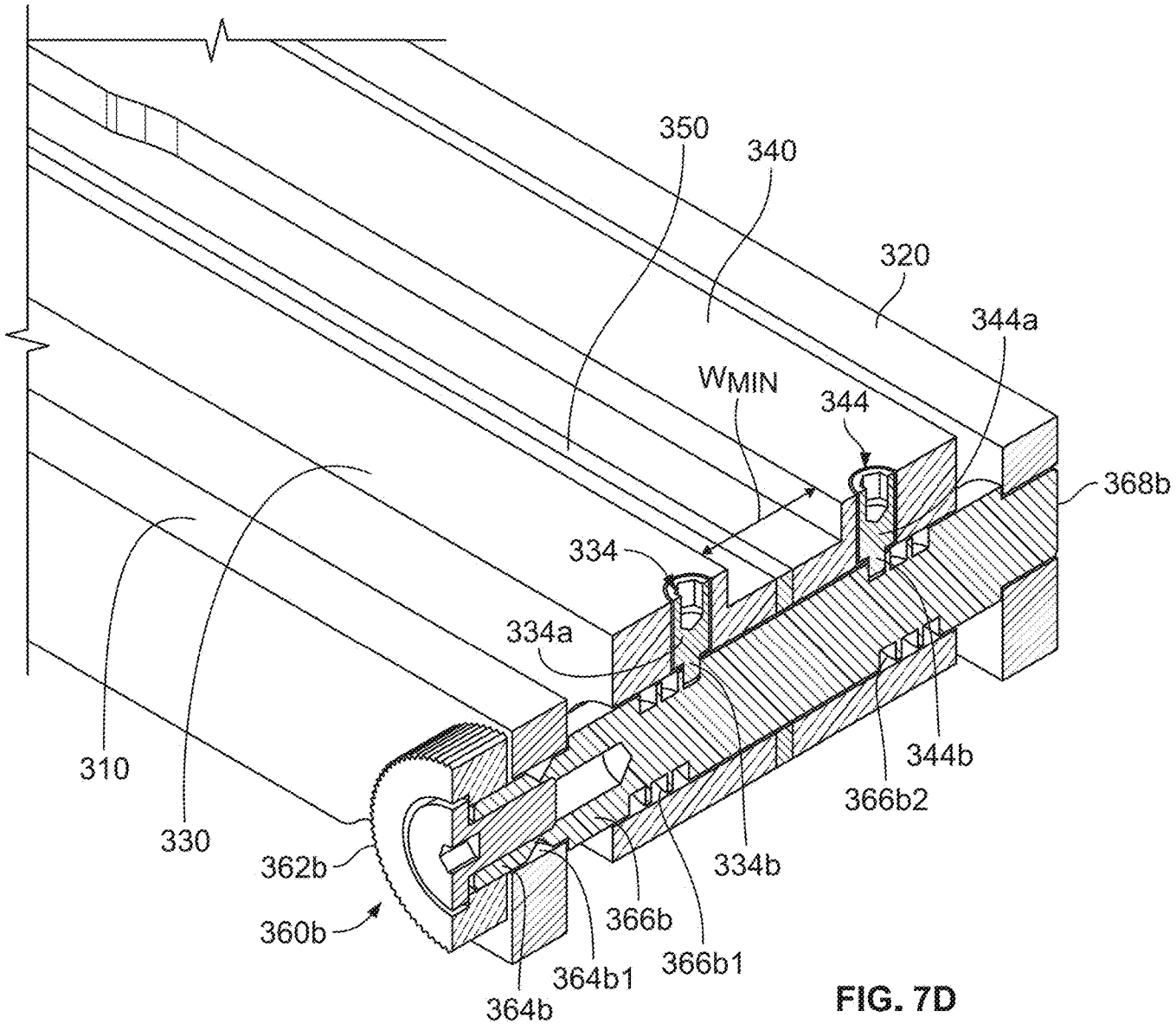
FIG. 7D is a cross-sectional perspective view of the lower strap-guiding assembly of FIG. 7A taken along line 7D-7D of FIG. 7A and showing the first and second guide members in their first (narrow) configuration.
Figure 7E:
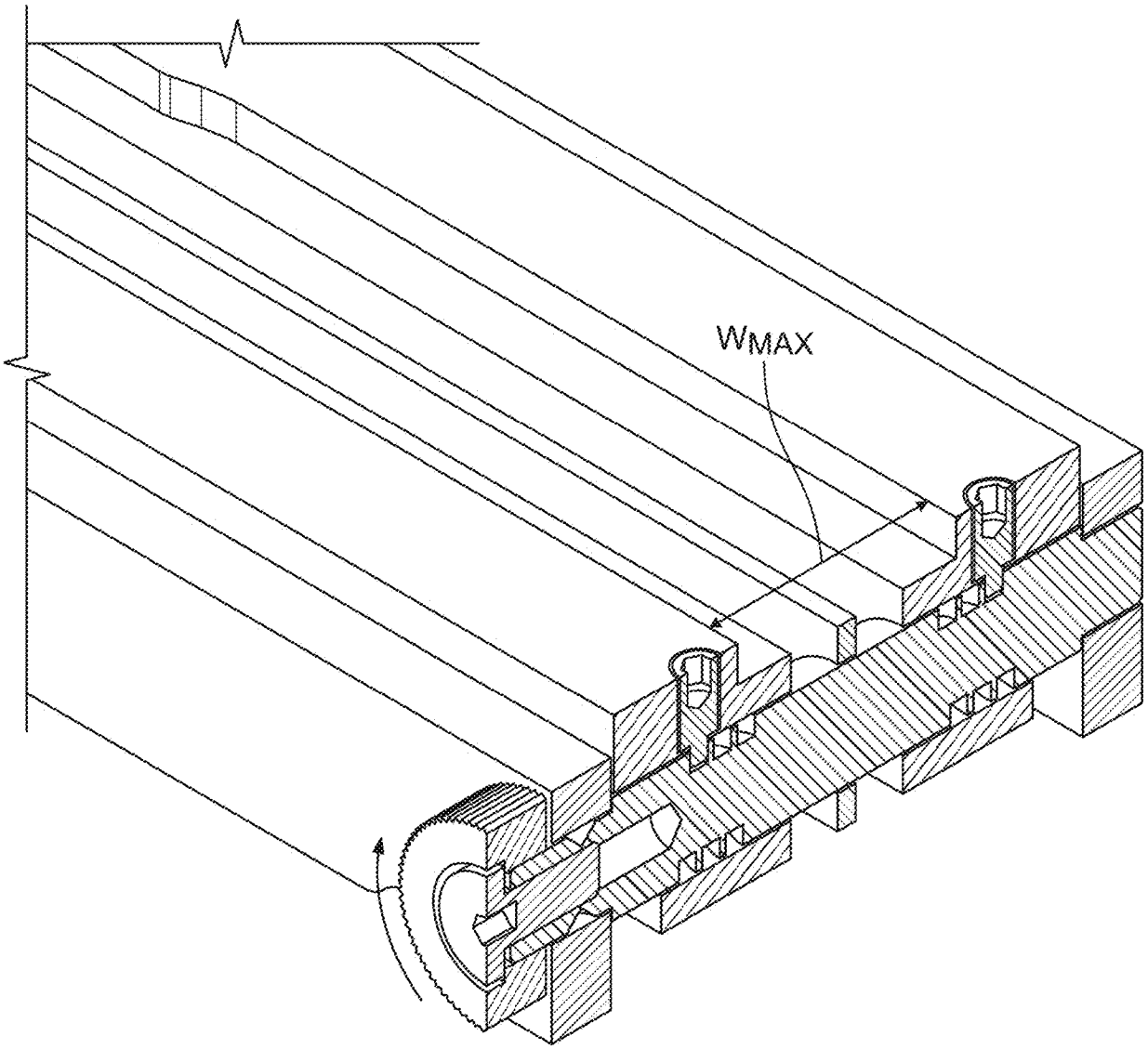
FIG. 7E is a cross-sectional perspective view of the lower strap-guiding assembly of FIG. 7A taken along line 7D-7D of FIG. 7A and showing the first and second guide members in their second (wide) configuration.
Figure 7F:
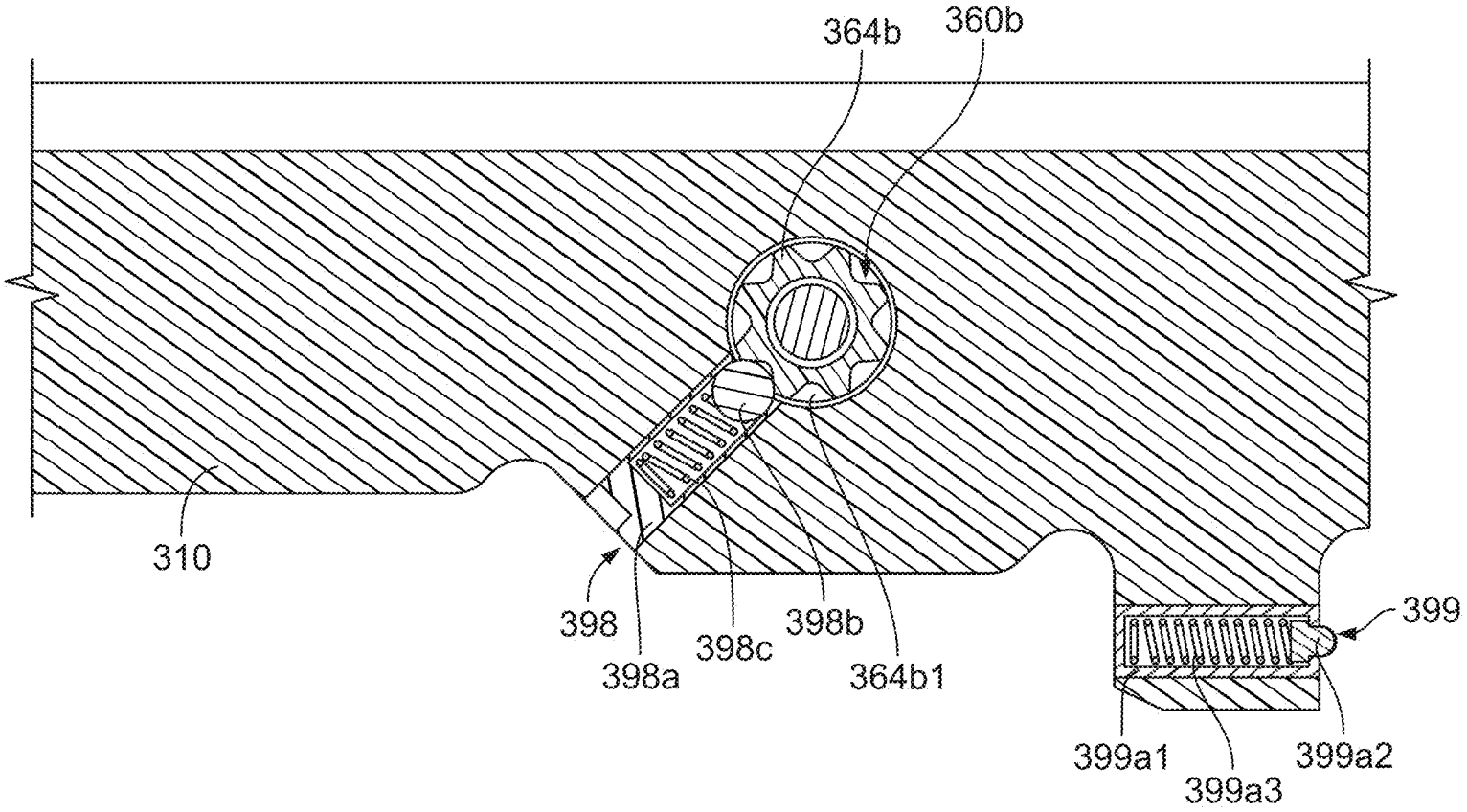
FIG. 7F is a cross-sectional side view of the lower strap-guiding assembly of FIG. 7A taken along line 7F-7F of FIG. 7A and showing the retainer.

The lower-strap-guiding-assembly retainers 399*a* and 399*b* retain the lower strap-guiding assembly 300 on the strap-feeding-assembly frame 100, as described below. In this example embodiment, the lower-strap-guiding-assembly retainers include spring plungers, though they may be any other suitable components in other embodiments. FIG. 7F shows the lower-strap-guiding-assembly retainer 399*a* (the lower-strap-guiding-assembly retainer 399*b* is identical and is not separately shown or described for brevity). The lower-strap-guiding-assembly retainer 399*a* includes a body 399*a*1 threadably received in the foot 316*a*, a nose 399*a*2 captively received within a bore defined in the body 399*a*1, and a biasing element 399*a*3 (here, a compression spring) biasing the nose 399*a*2 toward the opening of the bore such that part of the nose 399*a*2 projects from the bore.

The first and second guide frame members 310 and 320 and the center guide member 350 (which is a plate in this example embodiment) are fixedly connected to one another by the spacers 370*a*-370*d* and the fasteners 390 to form a lower strap-guiding-assembly frame. Due to this fixed connection in this example embodiment, there is a first fixed distance between the first and second guide frame members 310 and 320, a second fixed distance between the first guide frame member 310 and the center guide member 350, and a third fixed distance (which here is the same as the second fixed distance) between the second guide frame member 320 and the center guide member 350. The first outer guide member 330 is slidably mounted to the spacers 370*a*-370*d* (which extend through corresponding openings in the first outer guide member 330) between the first guide frame member 310 and the center guide member 350 such that the first outer guide member 330 can move relative to the frame members and the center guide member between a first position adjacent the first guide frame member 310 (FIG. 7E) and a second position adjacent the center guide member 350 (FIG. 7D). Similarly, the second outer guide member 340 is slidably mounted to the spacers 370*a*-370*d* (which extend through corresponding openings in the second outer guide member 340) between the second guide frame member 320 and the center guide member 350 such that the second outer guide member 340 can move relative to the frame members and the center guide member between a first position adjacent the second guide frame member 320 (FIG. 7E) and a second position adjacent the center guide member 350 (FIG. 7D).

As best shown in FIG. 7A, a first feed-wheel-receiving opening 300*a* is formed between the first outer guide member 330 and the center guide member 350 and a second feed-wheel-receiving opening 300*b* is formed between the second outer guide member 340 and the center guide member 350. Two of the guide rollers 395 are mounted to the first outer guide member 330 on the infeed and outfeed sides of the first feed-wheel-receiving opening 300*a* and extend partially into the strap channel SC. Similarly, two of the guide rollers 395 are mounted to the second outer guide member 340 on the infeed and outfeed sides of the second feed-wheel-receiving opening 300*b* and extend partially into the strap channel SC. In this example embodiment, the guide rollers 395 are rotatable relative to the outer guide members 330 and 340, while in other embodiments the guide rollers are not rotatable relative to the outer guide members 330 and 340. The strap engages the guide rollers as it moves through the strap channel SC, and the guide rollers help keep the strap in the lateral center of the strap channel SC and limits the strap's contact with the outer walls of the strap channel SC, thereby reducing debris formation and the potential for the strap to be damaged.

The first and second biasing elements 380*a* and 380*b* bias the first outer guide member 330 to its first position, and the third and fourth biasing elements 380*c* and 380*d* bias the second outer guide member 340 to its first position. In this example embodiment, the biasing elements 380*a*-380*d* are compression springs. Also, in this example embodiment: the first biasing element 380*a* circumscribes the portion of the first spacer 370*a* between the first guide frame member 310 and the center guide member 350 and engages the first outer guide member 330 and the center guide member 350, the second biasing element 380*b* circumscribes the portion of the fourth spacer 370*d* between the first guide frame member 310 and the center guide member 350 and engages the first outer guide member 330 and the center guide member 350, the third biasing element 380*c* circumscribes the portion of the first spacer 370*a* between the second guide frame member 320 and the center guide member 350 and engages the second outer guide member 340 and the center guide member 350, and the fourth biasing element 380*d* circumscribes the portion of the fourth spacer 370*d* between the second guide frame member 320 and the center guide member 350 and engages the second outer guide member 340 and the center guide member 350.

The first and second strap-channel-width adjusters 360*a* and 360*b* control the positions of the first and second outer guide members 330 and 340 and therefore the width of the strap channel partially defined by the lower strap-guiding assembly 300, as described in detail below. In this example embodiment, the first and second strap-channel-width adjusters 360*a* and 360*b* are identical, so only the first strap-channel-width adjuster 360*a* is shown and described in detail. Turning to FIG. 7C, the first strap-channel-width adjuster 360*a* includes a head 362*a*, a neck 364*a*, a body 366*a*, and a foot 368*a*. The head 362*a* is disc-shaped and has a toothed or knurled outer cylindrical surface to facilitate a user grasping and rotating the first strap-channel-width adjuster 360*a* (as described below). In other embodiments the head is coated with or is formed from a high-friction material, such as rubber. The neck 364*a* extends from the head 362*a* and, in this example embodiment, the head 362*a* is attached to the neck 364*a* via a fastener (not labeled). The neck 364*a* is cylindrical, and multiple aligned, circumferentially spaced depressions 364*a*1 are defined in the outer cylindrical surface of the neck 364*a*. The body 366*a* extends from the neck 364*a* (and in this example embodiment is integrally formed with the neck 364*a*). First and second spiral-shaped width-control grooves 366*a*1 and 366*a*2 are defined in the outer cylindrical surface of the body 366*a*. The width-control grooves 366*a*1 and 366*a*2 are mirror images of one another. For instance, if the width-control groove 366*a*1 is a right-hand spiral, the width-control groove 366*a*2 is a left-hand spiral, and vice-versa. The foot 368*a* is cylindrical and extends from the body 366*a* (and in this example embodiment is integrally formed with the body 366*a*). The first strap-channel-width adjuster 360*a* defines a rotational axis $A_{360a}$. The second strap-channel-width adjuster 360*b* has identical components that are identified below with element numbers in which a "b" replaces the "a" of the corresponding element numbers of the first strap-channel-width adjuster 360*a*.

The first and second strap-channel-width adjusters 360*a* and 360*b* extend through openings defined in the first and second guide frame members 310 and 320, the first and second outer guide members 330 and 340, and the center guide member 350. The first and second strap-channel-width adjusters 360*a* and 360*b* are secured (such as via set screws, retaining clips or rings, or in any other suitable manner) such that they cannot move relative to these components parallel or transverse to their respective rotational axes $A_{360a}$ and $A_{360b}$ but can rotate relative to these components about their respective rotational axes $A_{360a}$ and $A_{360b}$. The first outer-guide-member director 332 has a threaded body 332*a* and a projection 332*b* extending from the body 332*a*. The body 332*a* of the first outer-guide-member director 332 is threadably received in the first outer guide member 330 such that the projection 332*b* of the first outer-guide-member director is received in the width-control groove 366*a*1 of the body 366*a* of the first strap-channel-width adjuster 360*a*. The second outer-guide-member director 334 has a threaded body 334*a* and a projection 334*b* extending from the body 334*a*. The body 334*a* of the second outer-guide-member director 334 is threadably received in the first outer guide member 330 such that the projection 334*b* of the second outer-guide-member director is received in the width-control groove 366*b*1 of the body 366*b* of the second strap-channel-width adjuster 360*b*. The third outer-guide-member director 342 has a threaded body 342*a* and a projection 342*b* extending from the body 342*a*. The body 342*a* of the third outer-guide-member director 342 is threadably received in the second outer guide member 340 such that the projection 342*b* of the third outer-guide-member director is received in the width-control groove 366*a*2 of the body 366*a* of the first strap-channel-width adjuster 360*a*. The fourth outer-guide-member director 344 has a threaded body 344*a* and a projection 344*b* extending from the body 344*a*. The body 344*a* of the fourth outer-guide-member director 344 is threadably received in the second outer guide member 340 such that the projection 344*b* of the fourth outer-guide-member director is received in the width-control groove 366*b*2 of the body 366*b* of the second strap-channel-width adjuster 360*b*.

As best shown in FIG. 7A, the outer guide members 330 and 340 (along with the upper strap-guiding assembly 400) define a strap channel SC therebetween that has a width W. When the first and second outer guide members 330 and 340 are in their respective second positions, referred to herein as a second (narrow) configuration, the width of the strap channel SC is a minimum width $W_{MIN}$ (FIG. 7D). Conversely, when the first and second outer guide members are in their respective first positions, referred to herein as a first (wide) configuration, the width of the strap channel SC is a maximum width $W_{MAX}$ (FIG. 7E). The width of the strap channel SC is adjustable between the minimum and maximum widths $W_{MIN}$ and $W_{MAX}$ via rotation of the first and second strap-channel-width adjusters 360*a* and 360*b*, which enables the operator to tailor the width of the strap channel to conform to strap of different sizes. Put differently, the first and second strap-channel-width adjusters 360*a* and 360*b* are operably connected to the first and second outer guide members 330 and 340 to move the first and second outer guide members between their respective first and second positions to adjust the width of the strap channel SC.

Specifically, as explained above, the projections of the outer-guide-member directors are received in the spiral-shaped width-control grooves of the strap-channel-width adjusters. As the strap-channel-width adjusters are rotated, the projections follow the grooves and force the outer guide members to move toward or away from one another (depending on the direction of rotation). FIGS. 7D and 7E illustrate this for the second strap-channel-width adjuster 360*b*. In FIG. 7D the first and second outer guide members 330 and 340 are in the second (narrow) configuration (i.e., are in their respective second positions) and the width of the strap channel SC is $W_{MIN}$. To move the first and second outer guide members 330 and 340 away from one another and toward the first (wide) configuration, the operator rotates the second strap-channel-width adjuster 360*b* clockwise (from the perspective shown in FIGS. 7D and 7E). Initially, the projections 334*b* and 344*b* of the second and fourth guide-place directors 334 and 344—which are respectively received in the first and second width-control grooves 366*b*1 and 366*b*2 of the body 366*b* of the second strap-channel-width adjuster 366—are positioned at the ends of the grooves nearest the longitudinal center of the body. As the second strap-channel-width adjuster 360*b* rotates, the walls that define the width-control grooves force the projections outward such that they follow the grooves and move toward the ends of the grooves furthest from the longitudinal center of the body. This in turn forces the first and second outer guide members 330 and 340 to move toward the first configuration, as shown in FIG. 7E.

The strap-channel-width-adjuster retainers 398 engage the strap-channel-width adjusters 360*a* and 360*b* to help maintain the strap-channel-width adjusters 360*a* and 360*b* in their rotational positions by resisting rotation. In this example embodiment, the strap-channel-width-adjuster retainers 398 include spring plungers, though they may be any other suitable components in other embodiments. FIG. 7F shows one strap-channel-width-adjuster retainer engaging the second strap-channel-width adjuster 360*b* (another identical strap-channel-width-adjuster retainer engages the first strap-channel width adjuster 360*a* and is not shown for brevity). The strap-channel-width-adjuster retainer 398 includes a body 398*a* threadably received in the first guide frame member 310, a nose 398*b* captively received within a bore defined in the body 398*a*, and a biasing element 398*c* (here, a compression spring) biasing the nose 398*b* toward the opening of the bore such that part of the nose 398*b* projects from the bore. The strap-channel-width-adjuster retainer 398 is positioned so the nose 398*b* is adjacent to and received in the depressions 364*b*1 in the neck 364*a* of the strap-channel-width adjuster 360. To rotate the strap-channel-width adjuster, the force of the spring 398*c* must be overcome. This prevents unwanted rotation of the strap-channel-width adjuster.

Figure 8A:
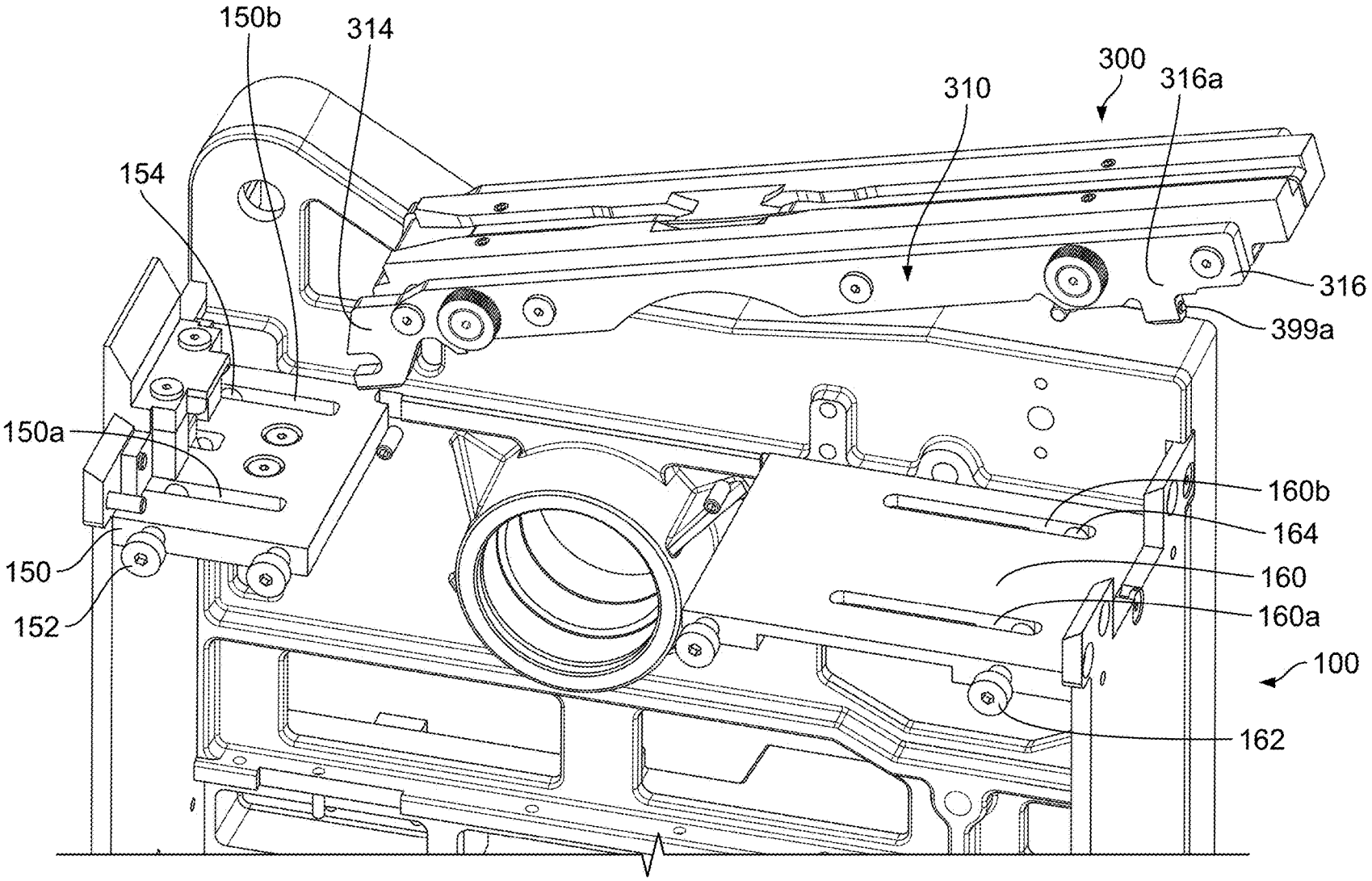
FIG. 8A is a perspective view showing the lower strap-guiding assembly of FIG. 7A removed from the strap-feeding-assembly frame.

As shown in FIGS. 8A-8D, the lower strap-guiding assembly 300 is removably mounted to the strap-feeding-assembly frame 100 generally above the strap-driving assembly 200. Specifically, the lower strap-guiding assembly 300 is removably mounted to first (infeed) and second (outfeed) lower-strap-guiding-assembly mounts of the strap-feeding-assembly frame 100. In this example embodiment, the first lower-strap-guiding-assembly mount includes the first-support-member mounting elements 152 and 154, which are accessible via openings 150*a* and 150*b* defined through the first platform 150 (FIG. 8A). The second lower-strap-guiding-assembly mount includes the second-support-member-mounting elements 162 and 164, which are accessible via openings 160*a* and 160*b* defined through the second platform 160 (FIG. 8A).

Figure 8B:
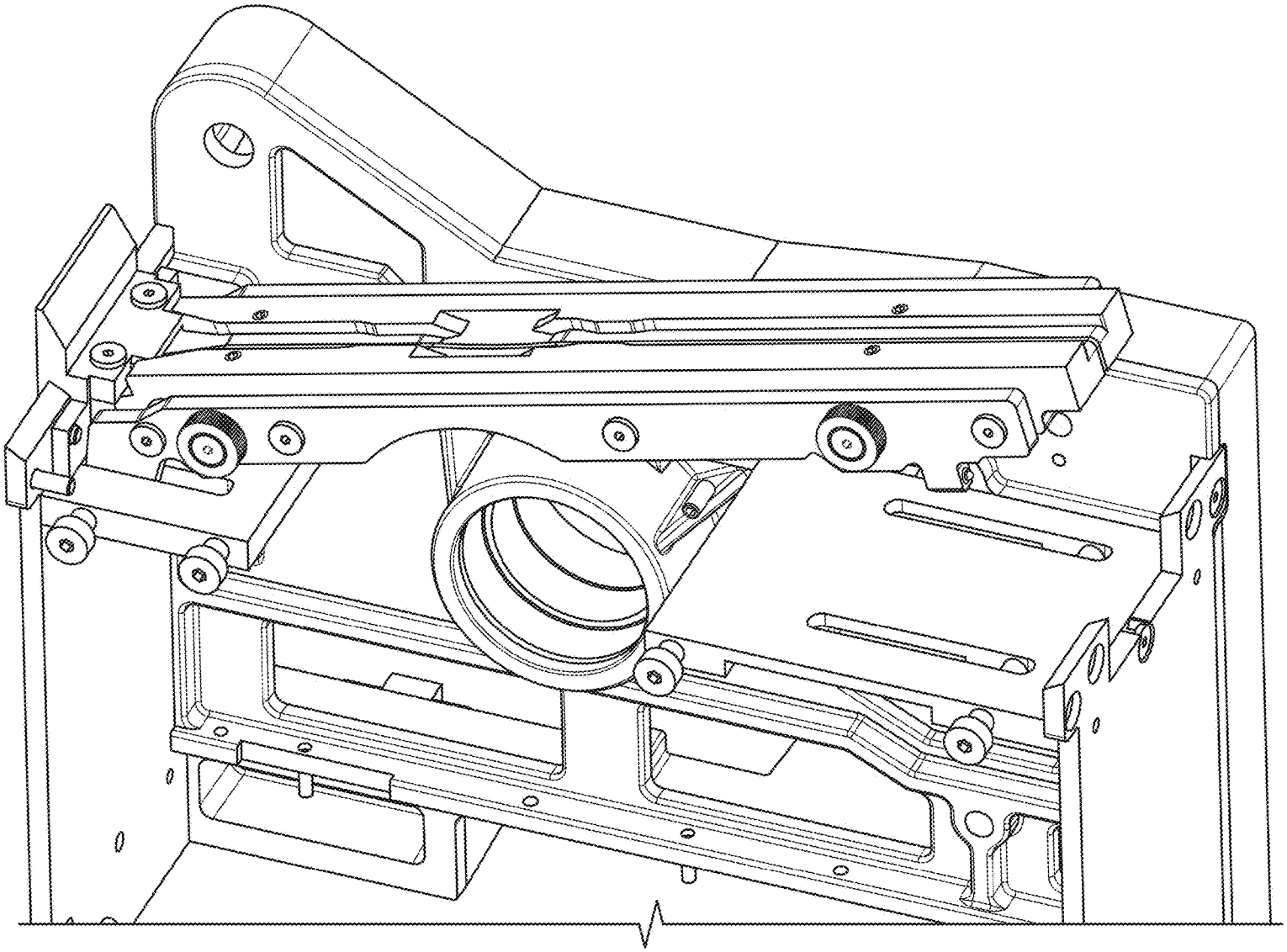
FIGS. 8B and 8C are perspective views showing the lower strap-guiding assembly of FIG. 7A being mounted to the strap-feeding-assembly frame.
Figure 8C:
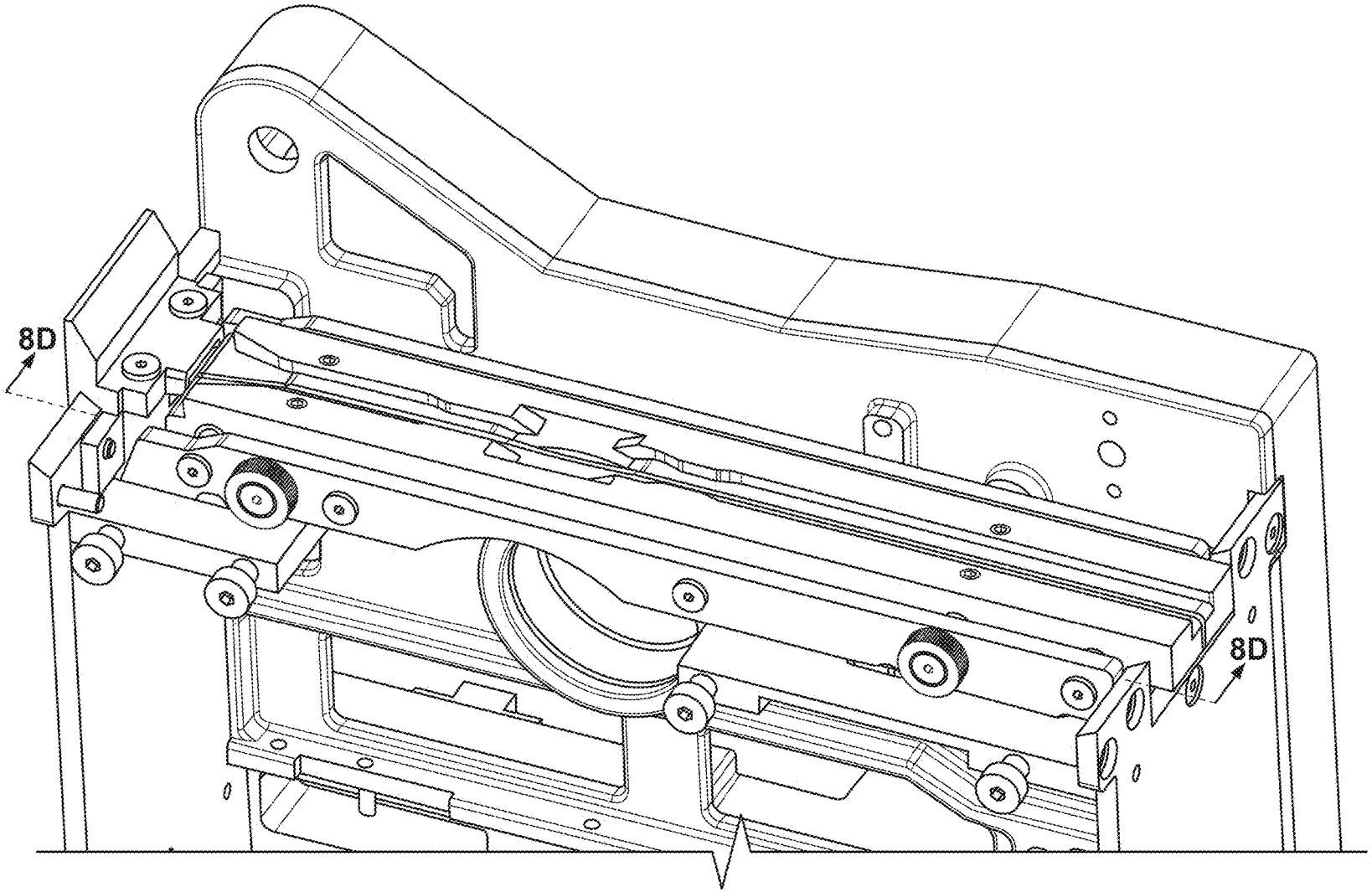
Figure 8D:
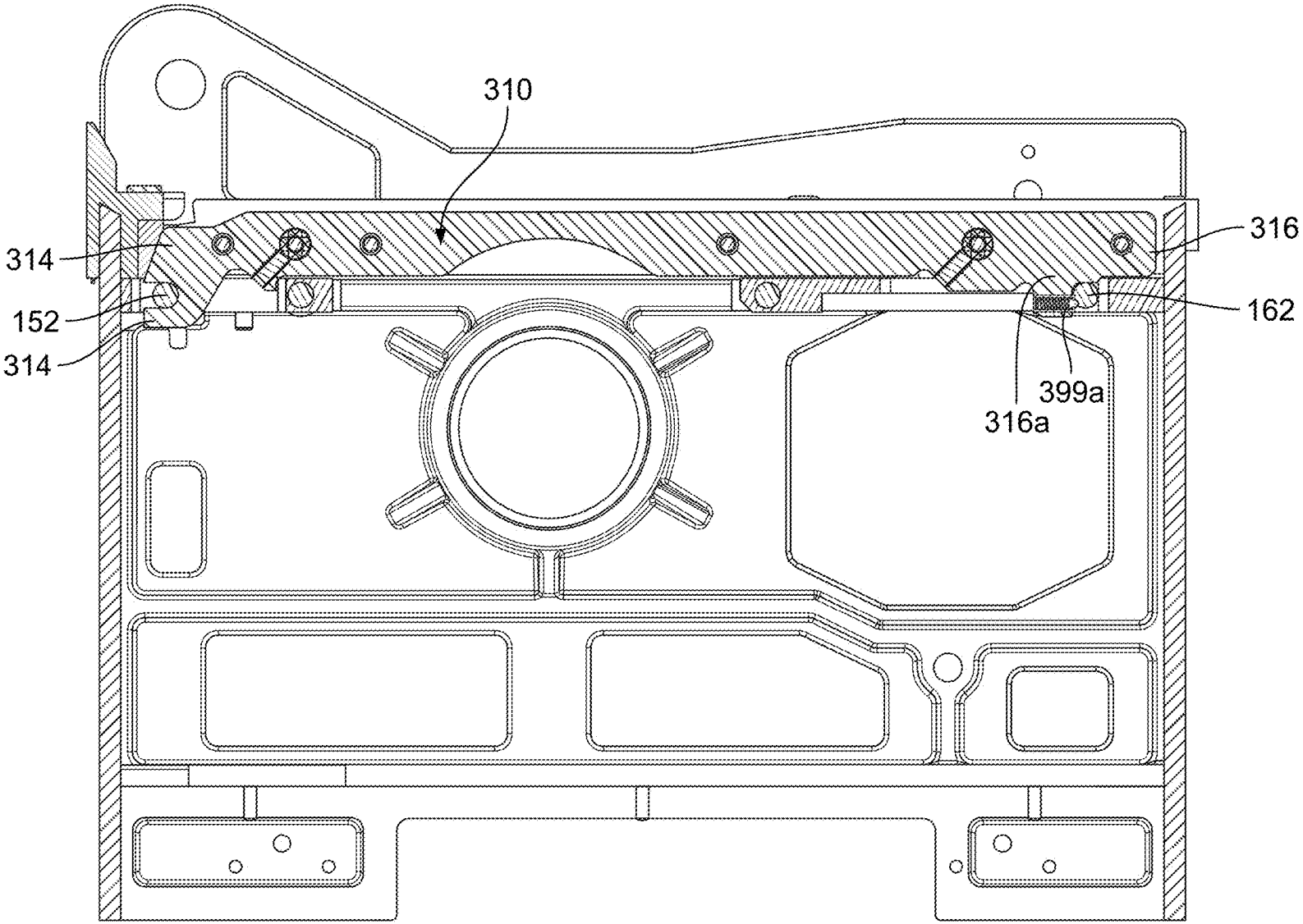
FIG. 8D is a cross-sectional view of the lower strap-guiding assembly of FIG. 7A mounted to the strap-feeding-assembly frame taken along line 8D-8D of FIG. 8C.

To mount the lower strap-guiding assembly 300 to the strap-feeding-assembly frame 100, the lower portions of the first ends 314 and 324 of the first and second guide frame members 310 and 320 are inserted into the openings 150*a* and 150*b* in the first platform 150, respectively, and positioned so the first-support-member mounting elements 152 and 154 (i.e., the first lower-strap-guiding-assembly mount in this example embodiment) are received in their respective mounting openings 314*a* and 324*a*, as shown in FIG. 8B. The lower strap-guiding assembly 300 is then rotated about the first-support-member mounting elements 152 and 154 and toward the second platform 160 until the: (1) undersides of the second ends 316 and 326 of the first and second guide frame members 310 and 320 lockingly engage the second-support-member-mounting elements 162 and 164 (i.e., the second lower-strap-guiding-assembly mount in this example embodiment), respectively; and (2) the noses 399*a*2 and 399*b*2 of the lower-strap-guiding-assembly retainers 399*a* and 399*b* engage the second-support-member-mounting elements 162 and 164, respectively, as shown in FIGS. 8C and 8D.

Once the lower strap-guiding assembly 300 is in this operational position, the lower-strap-guiding-assembly retainers 399*a* and 399*b* retain it in place. More specifically, the spring-biased noses 399*a*2 and 399*b*2 resist rotation of the strap-guiding assembly 300 away from its operational position. To remove the lower strap-guiding assembly 300 from the strap-feeding assembly frame 100, the operator reverses the above sequence, making sure to lift with enough force to overcome the forces of the springs 399*a*3 and 399*b*3 of the lower-strap-guiding-assembly retainers 399*a* and 399*b*. The operator therefore does not need any tools to remove the lower strap-guiding assembly from the strap-feeding-assembly frame (at least in this example embodiment), making removal quick and easy.

In certain embodiments, the second strap-guiding-assembly mount defines an opening sized to receive part of the nose when the strap-guiding assembly is in its operational position.

As shown in FIG. 4, the lower strap-guiding assembly 300 (when mounted to the strap-feeding-assembly frame 100) is positioned such that the strap-engaging surface 210*a* of the feed wheel 210 extends into the first feed-wheel-receiving opening 300*a* and the strap-engaging surface 210*b* of the feed wheel 210 extends into the second feed-wheel-receiving opening 300*b* such that these surfaces can engage the strap (when the strap is received in the strap channel SC).

The upper strap-guiding assembly 400, which is best shown in FIGS. 2-4 and 9A-14D, forces the strap against the feed wheel 210 of the strap-driving assembly 200 and is adjustable in two ways to accommodate different strap thicknesses. The upper strap-guiding assembly 400 includes a housing 405, a strap-channel cover 410, a counter-roller assembly 420, a counter-roller-assembly mounting pin 430, and a biasing assembly 440.

Figure 3:
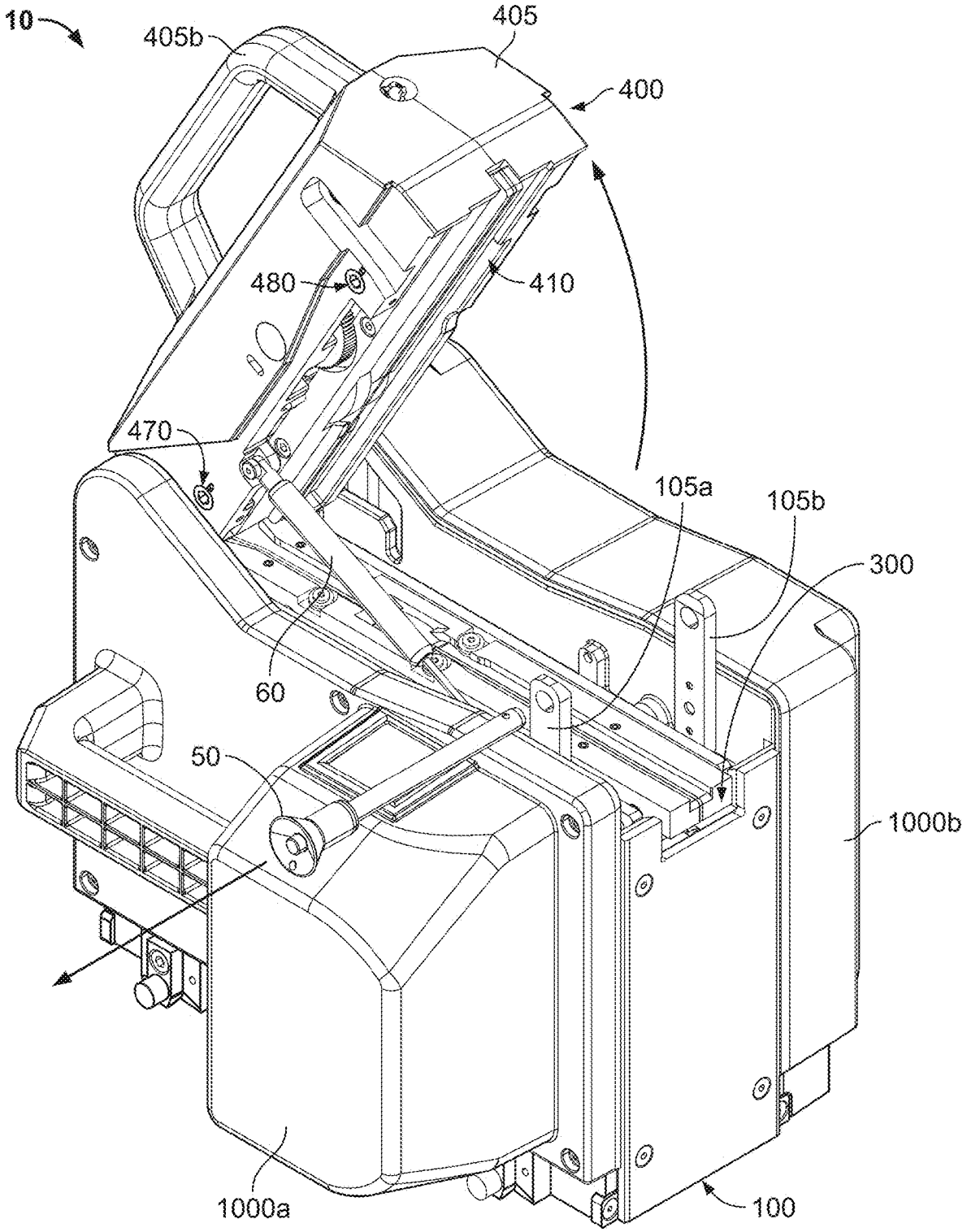
FIG. 3 is a perspective view of the strap-feeding assembly of FIG. 2 with its upper strap-guiding assembly in its open position.

The upper strap-guiding assembly 400 is mounted to the strap-feeding-assembly frame 100 and pivotable relative to the strap-feeding-assembly frame 100, the strap-driving assembly 200, and the lower strap-guiding assembly 300 about a pivot (not shown) between a closed position (FIG. 2) and an open position (FIGS. 3 and 4). A gas spring 60 (FIGS. 3 and 4) or other suitable component assists in pivoting the upper strap-guiding assembly 400 from its closed position to its open position and retains the upper strap-guiding assembly 400 in the open position (until it is forced back to the closed position against the force of the gas spring). When the upper strap-guiding assembly 400 is in its closed position, a locking pin 50 may be inserted through the upper strap-guiding assembly 400 and two cars 105*a* and 105*b* of the strap-feeding-assembly frame 100 to lock the upper strap-guiding assembly 400 in place and prevent it from pivoting from its closed position to its open position. The locking pin 50 must be removed (as shown in FIG. 3) before the upper strap-guiding assembly 400 can be pivoted to its open position.

The housing 405 supports some (or all) of the other components of the upper strap-guiding assembly 400 and may be formed of any suitable component(s) arranged in any suitable configuration. In this example embodiment, the housing 405 includes a handle 405*b* to facilitate carrying the strap-feeding assembly 10.

The strap-channel cover 410 covers the lower strap-guiding assembly 300 when the upper strap-guiding assembly 400 is in its closed position and, along with the lower strap-guiding assembly 300, forms the strap channel SC. The strap-channel cover 410 includes a base including first and second outer guide members 412*a* and 412*b* and a center guide member 414 extending along the lateral center of the base between the first and second outer guide members. As best shown in FIG. 9B, a first counter-roller-receiving opening 410*a* is formed between the first outer guide member 412*a* and the divider 414 and a second counter-roller-receiving opening 410*b* is formed between the second outer guide member 412*b* and the divider 414.

Figure 14A:
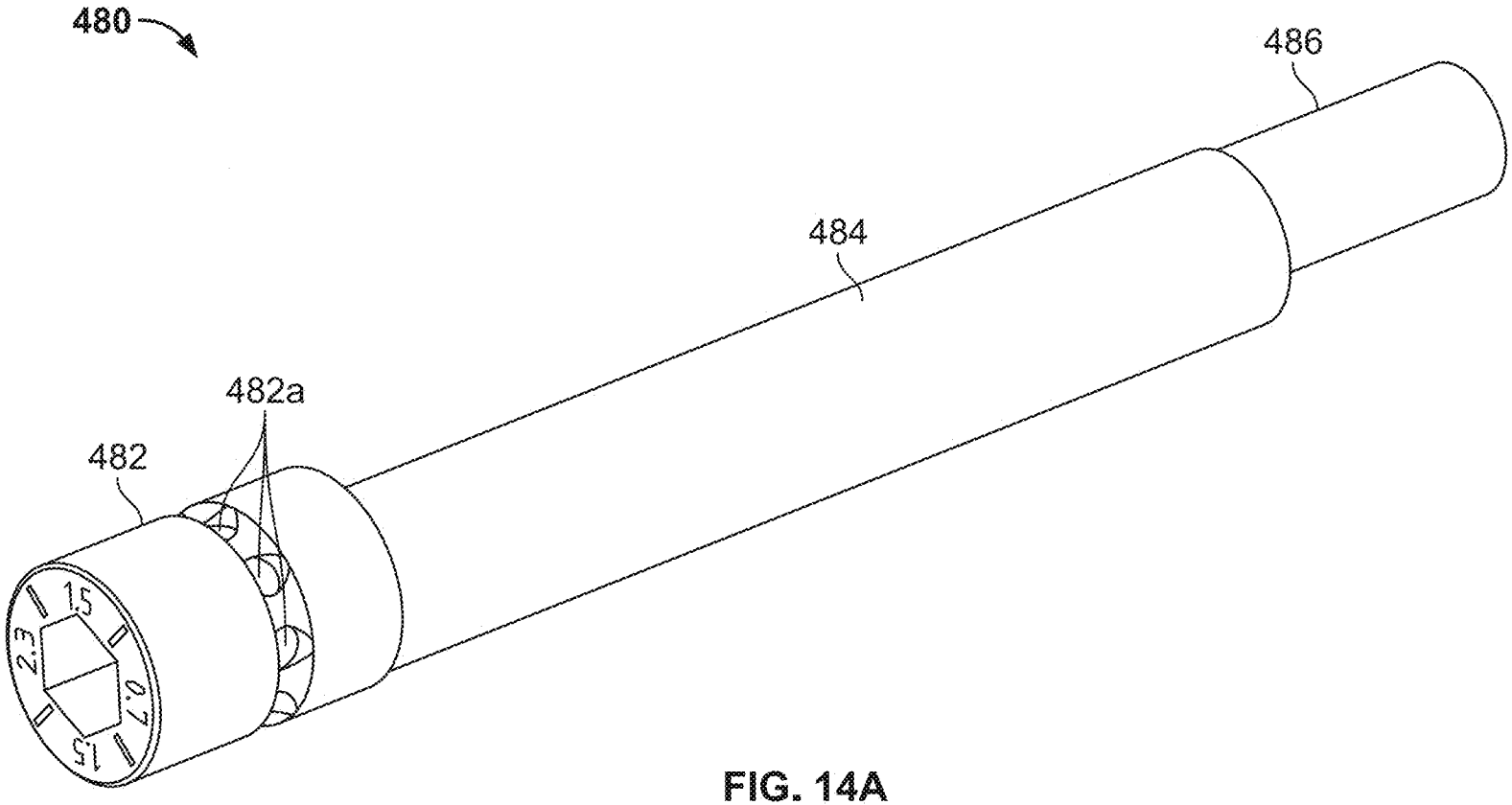
FIGS. 14A and 14B are perspective views of one of the eccentric mounting pins of the upper strap-guiding assembly.
Figure 14B:
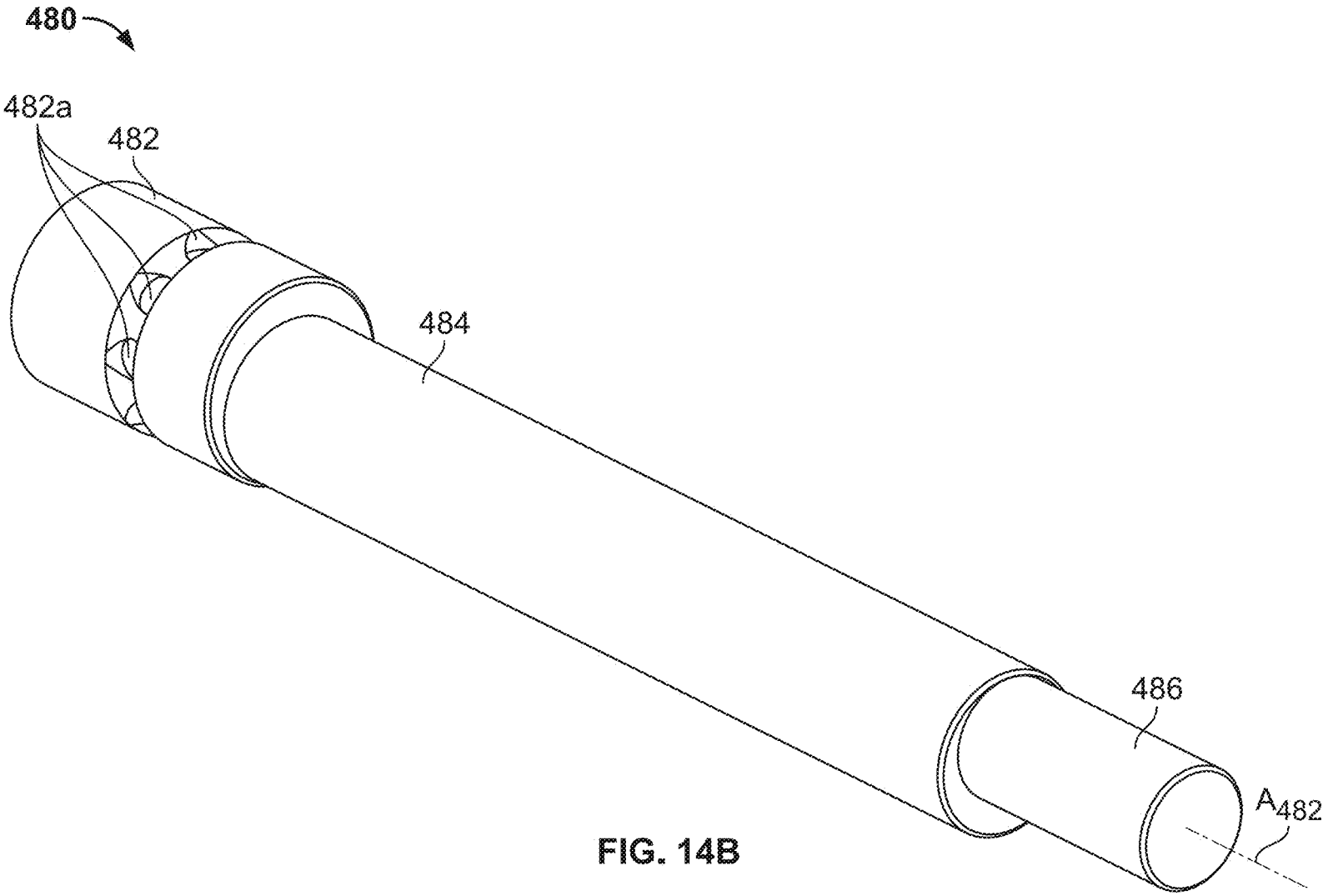
Figure 14C:
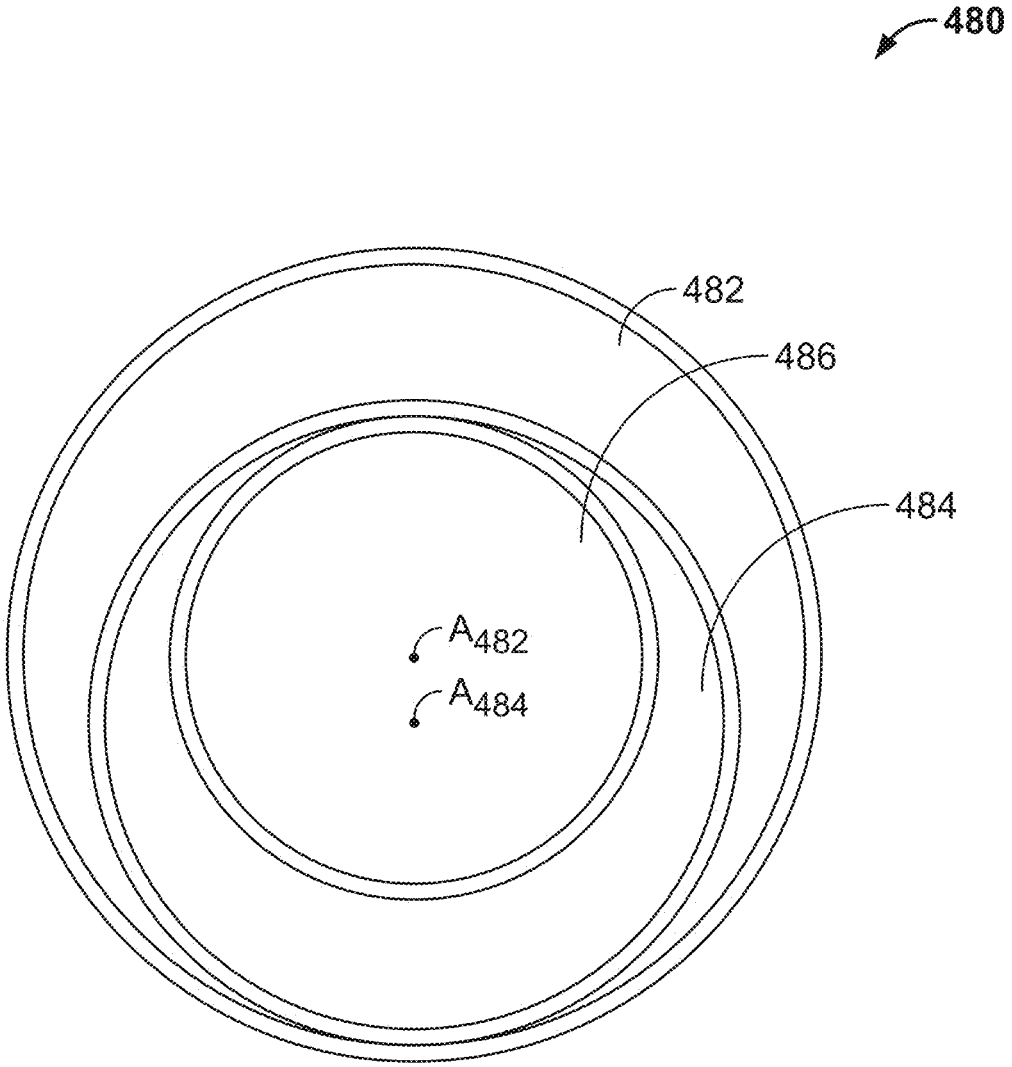
FIG. 14C is an end-on view of the eccentric mounting pin of FIGS. 14A and 14B.

The strap-channel cover 410 is removably mounted to the housing 405 via first and second eccentric mounting pins 470 and 480 (explained below with respect to FIGS. 14A-14D). The eccentric mounting pins 470 and 480 are manipulatable (here, rotatable) to control the distance between the strap-channel cover 410 and the lower strap-guiding assembly 300 and therefore control the height (not labeled) of the strap channel SC. In this example embodiment, the first and second eccentric mounting pins 470 and 480 are identical, so only the second eccentric mounting pin 480 is shown and described in detail. The second eccentric mounting pin 480 includes a head 482, a body 484, and a foot 486. The head 482 is cylindrical, and multiple aligned, circumferentially spaced depressions 482*a* are defined in the outer cylindrical surface of the head 482. The body 484 is cylindrical and extends from the head 482 (and in this example embodiment is integrally formed with the head 482). The foot 486 is cylindrical and extends from the body 484 (and in this example embodiment is integrally formed with the body 484). The head 482 and the foot 486 define a longitudinal axis $A_{482}$, and the body 484 defines a longitudinal axis $A_{484}$ that, as best shown in FIG. 14C, is laterally offset from the longitudinal axis $A_{482}$. Put differently, the body 484 is eccentrically mounted to the head 482 and the foot 486. The first eccentric mounting pin 470 has identical components.

Figure 14D:
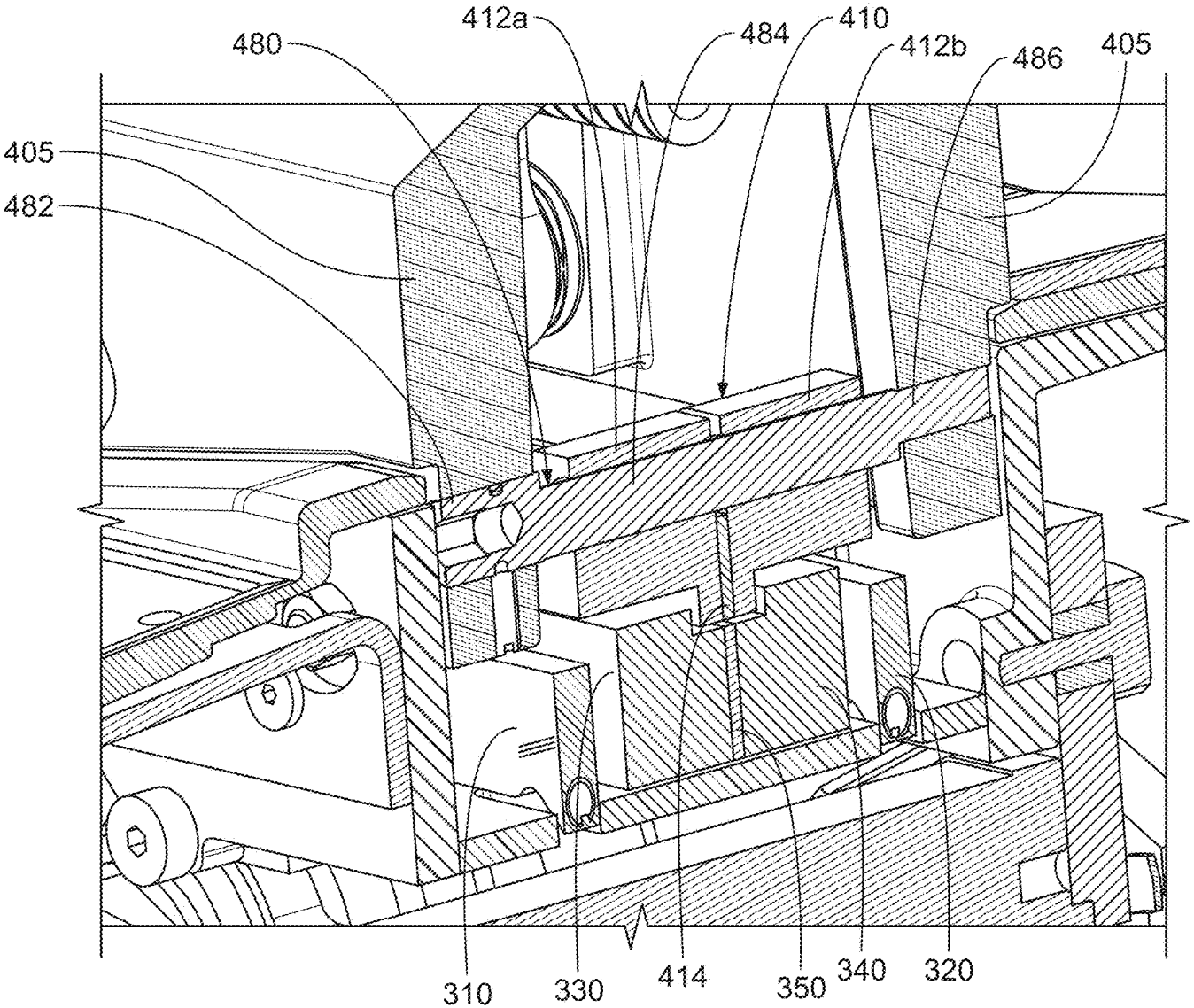
FIG. 14D is a cross-sectional perspective view showing the eccentric mounting pin of FIGS. 14A and 14B.

As shown in FIG. 14D, the head 482 and the foot 486 of the second eccentric mounting pin 480 are received in openings (not labeled) in the housing 405, and the body 484 of the eccentric mounting pin 480 extends through openings (not labeled) in the first and second outer guide members 412*a* and 412*b* of the base of the strap-channel cover 410. Due to this mounting configuration, the second eccentric mounting pin 480 is rotatable relative to the housing 405 and the strap-channel cover 410 about the first longitudinal axis $A_{482}$. Since the body 484 is eccentrically mounted to the head 482 and the foot 486, rotation of the second eccentric mounting pin 480 causes the body 484 to rotate around the first longitudinal axis $A_{482}$, which causes the strap-channel cover 410 to further from or closer to the lower strap-guiding assembly 300, thereby increasing or decreasing the height of the strap channel SC. Although not labeled for clarity, a spring-biased retainer (similar to the strap-channel-width-adjuster retainer 398 described above and shown in FIG. 7F) engages the depressions 482*a* to prevent unwanted rotation of the eccentric mounting pin 480.

Figure 10:
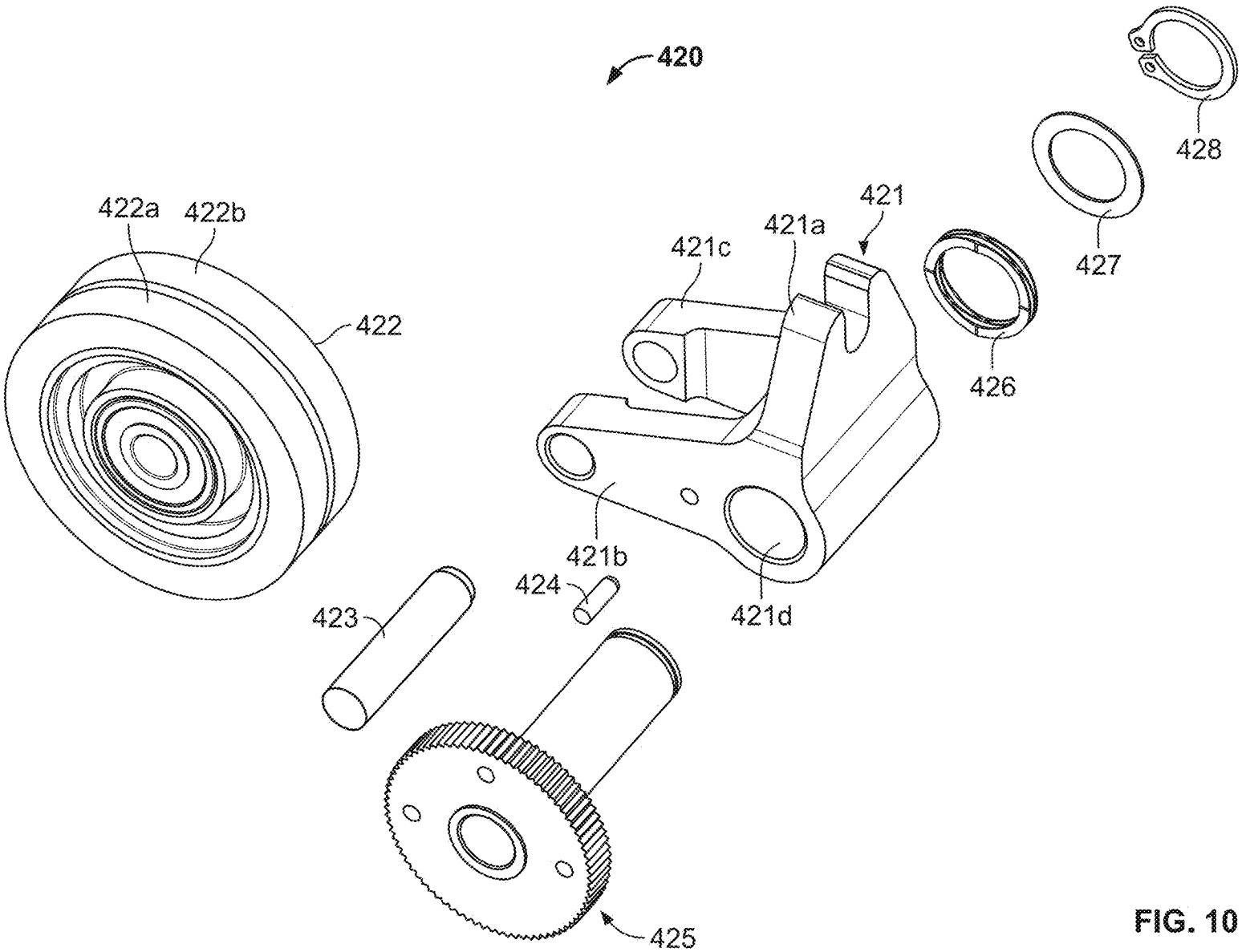
FIG. 10 is an exploded perspective view of the counter-roller assembly of the upper strap-guiding assembly of FIG. 9A.

The counter-roller assembly 420, best shown in FIG. 10, includes a support 421, a counter roller 422, a counter-roller mounting pin 423, a height-adjuster locking pin 424, a height adjuster 425, a height-adjuster biasing element 426, a washer 427, and a retaining ring 428. The support 421 includes a generally L-shaped body formed from a biasing-assembly-engagement arm 421*a* and two spaced-apart counter-roller-mounting arms 421*b* and 421*c*. A height-adjuster-receiving bore 421*d* is defined through the support 421 at the junction between the arm 421*a* and the arms 421*b* and 421*c*. The counter roller 422, which includes spaced-apart, circumferential strap-engaging surfaces 422*a* and 422*b*, is mounted between the counter-roller-mounting arms 421*b* and 421*c* via the counter-roller mounting pin 423. The counter roller 422 is freely rotatable about the counter-roller mounting pin 423 relative to the support 421. In this example embodiment, the counter roller 422 includes a bearing (not labeled) through which the counter-roller mounting pin 423 extends. The height-adjuster locking pin 424 is fixedly attached to and projects from the counter-roller-mounting arm 421*b* of the support 421 adjacent the height-adjuster-receiving bore 421*d*.

Figure 11A:
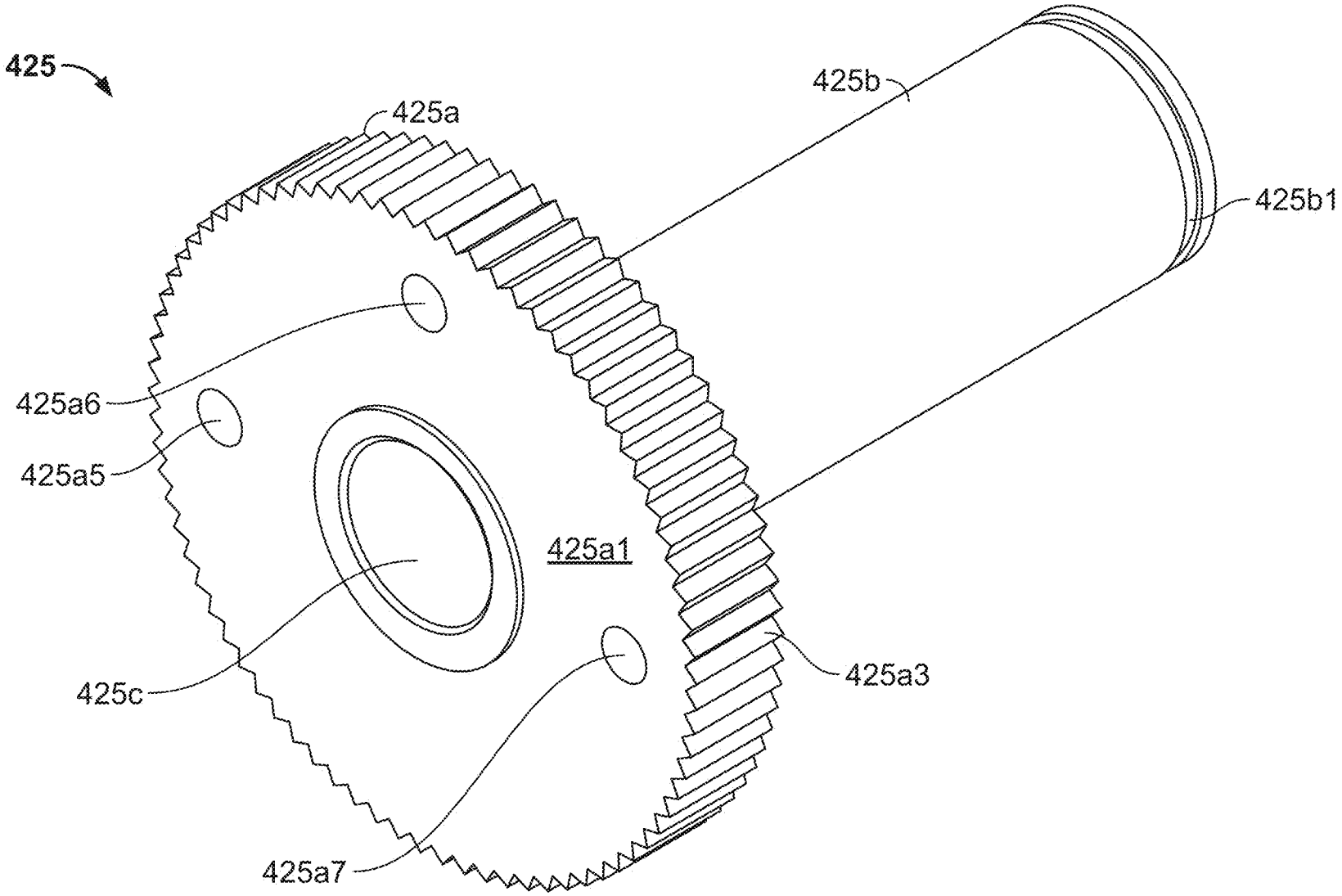
FIGS. 11A and 11B are perspective views and FIG. 11C is an side view of the height adjuster of the counter-roller assembly of FIG. 10.
Figure 11B:
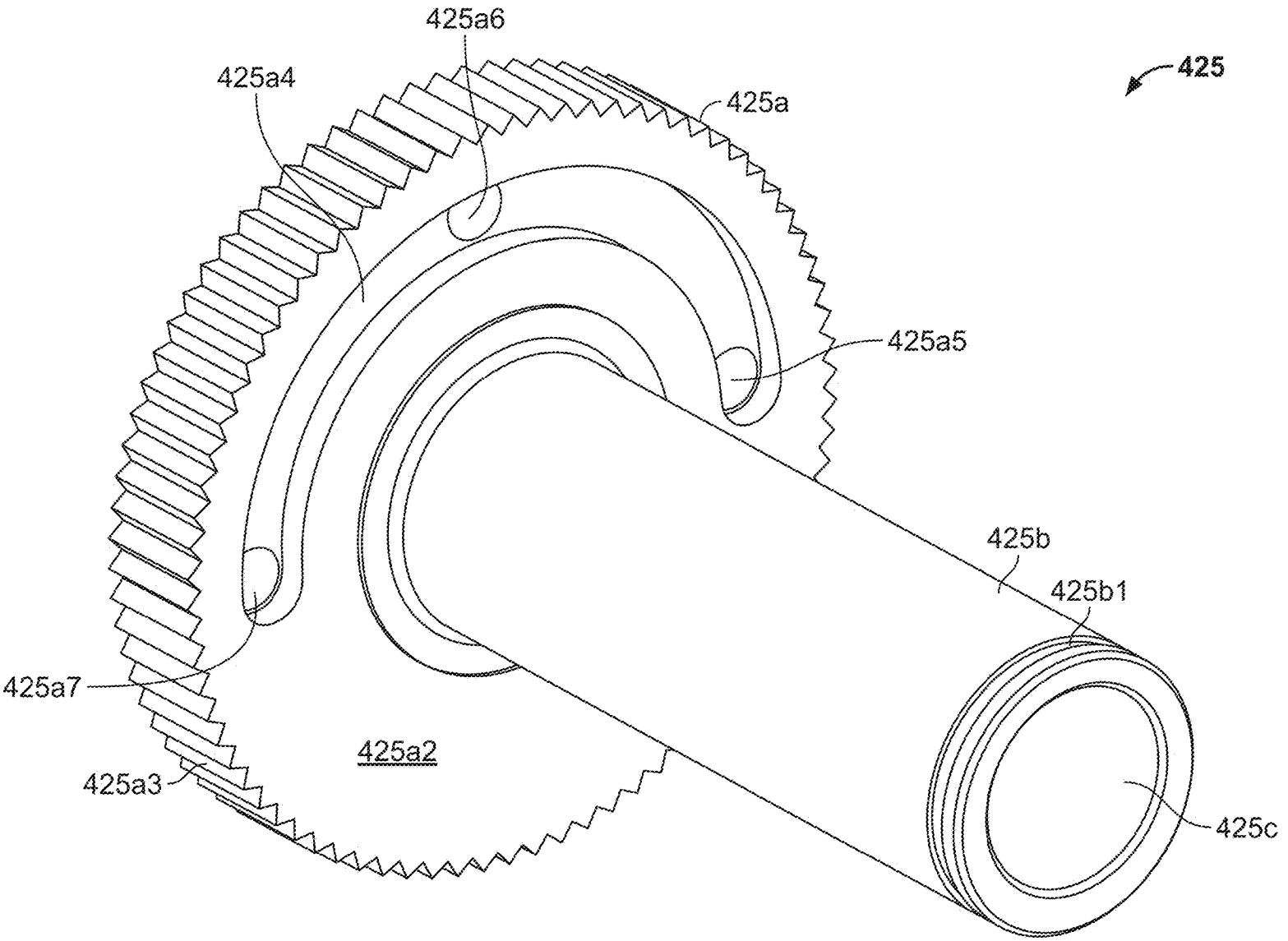
Figure 11C:
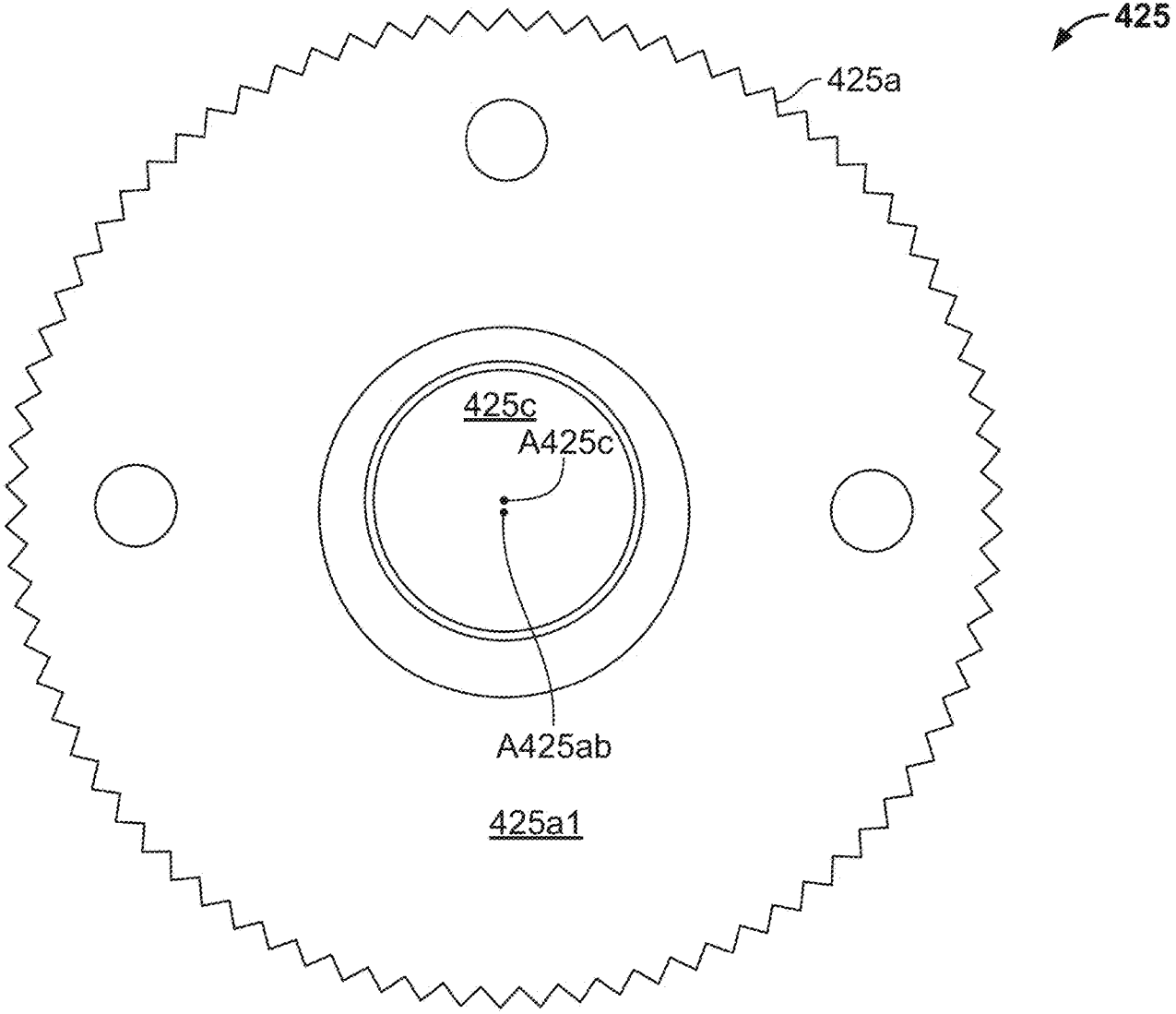

The height adjuster 425, best shown in FIGS. 11A-11C, includes a head 425*a* and a body 425*b*. The head 425*a* is disc-shaped and has an outer surface 425*a*1, an opposing inner surface 425*a*2, and a cylindrical perimeter surface 425*a*3 between the outer and inner surfaces. The perimeter surface 425*a*3 is toothed or knurled to facilitate a user grasping and rotating the height adjuster 425 (as described below). In other embodiments the head is coated with or is formed from a high-friction material, such as rubber. The neck 425*b* extends from the head 425*a* and, in this example embodiment, is integrally formed with the head 425*a*. The neck 425*b* is cylindrical, and a circumferential groove 425*b*1 is defined in the outer cylindrical surface of the neck 425*b* near its free end opposite the head 425*a*.

As shown in FIG. 11C, the head 425*a* and the neck 425*b* share a longitudinal axis $A_{425ab}$. As shown in FIG. 11B, a curved groove 425*a*4 is defined in the inner surface 425*a*2 of the head 425*a*. In this example embodiment, the groove 425*a*4 is radially located (relative to the axis $A_{425ab}$) between the perimeter surface 425*a*3 of the head 425*a* and the body 425*b*. And in this example embodiment, the groove 425*a*4 extends about 180 degrees. A first locking-pin-receiving bore 425*a*5 is defined through the head 425*a* and intersects the groove 425*a*4 at a first end of the groove 425*a*4, a third locking-pin-receiving bore 425*a*7 is defined through the head 425*a* and intersects the groove 425*a*4 at a second end of the groove 425*a*4, and a second locking-pin-receiving bore 425*a*6 is defined through the head 425*a* and intersects the groove 425*a*4 about halfway between the first and third locking-pin-receiving bores 425*a*5 and 425*a*7.

As best shown in FIG. 11C, a mounting-pin-receiving bore 425*c* is defined through the head 425*a* and the neck 425*b*. The mounting-pin-receiving bore 425*c* has a longitudinal axis $A_{425c}$ that is parallel to and offset from (i.e., not coaxial with) the axis $A_{425ab}$. The fact that these axes are offset (i.e., that the mounting-pin-receiving bore 425*c* does not share the same longitudinal axis as the head 425*a* and the neck 425*b*) enables the height of the counter roller 422 relative to the feed wheel 210 to be adjusted to accommodate for strap of different thicknesses, as described below.

Figure 12A:
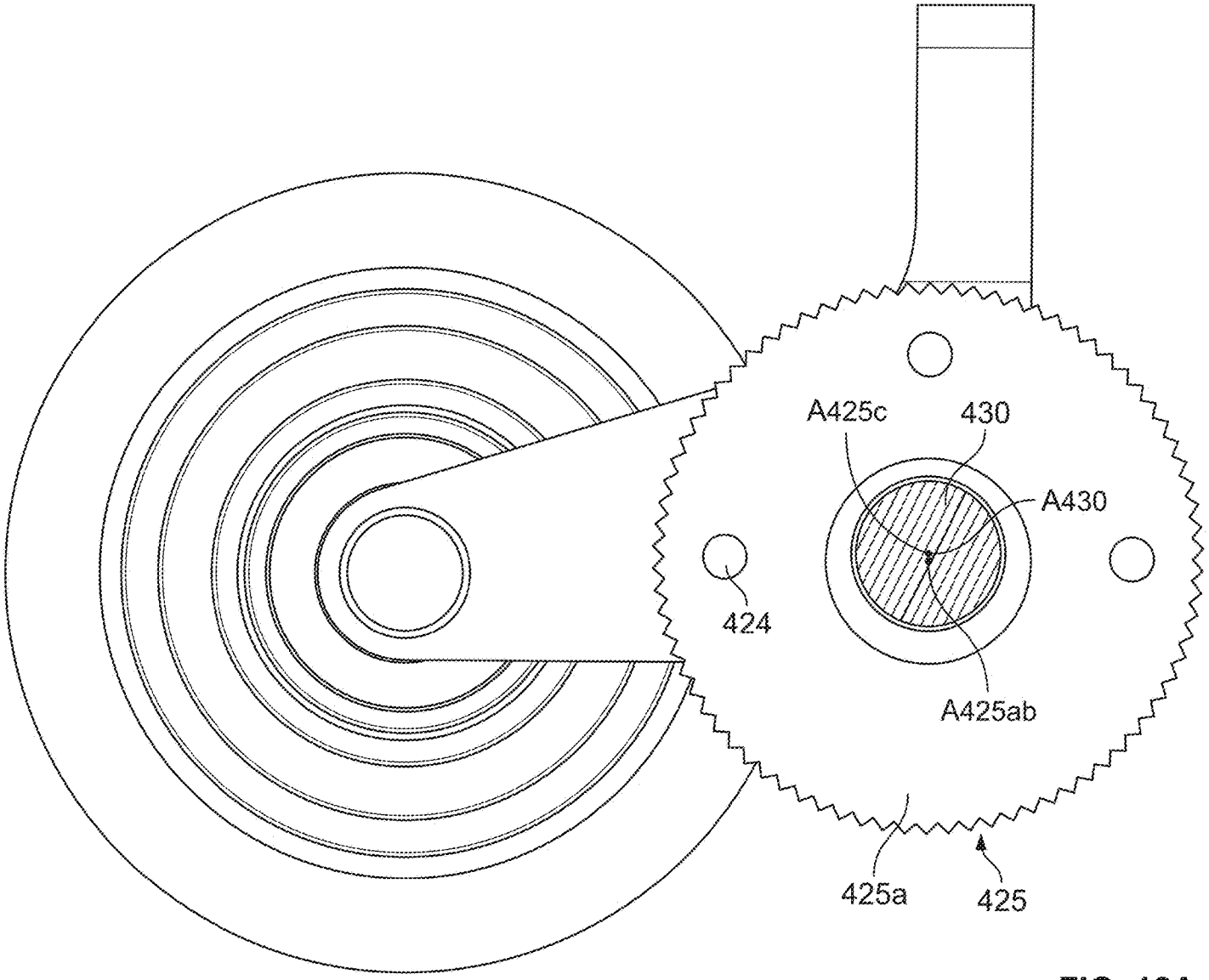
FIGS. 12A-12C are side views of part of the counter-roller assembly showing movement of the height adjuster from its locked position to its unlocked position and from its first rotational position to its second rotational position. More specifically.
Figure 12B:
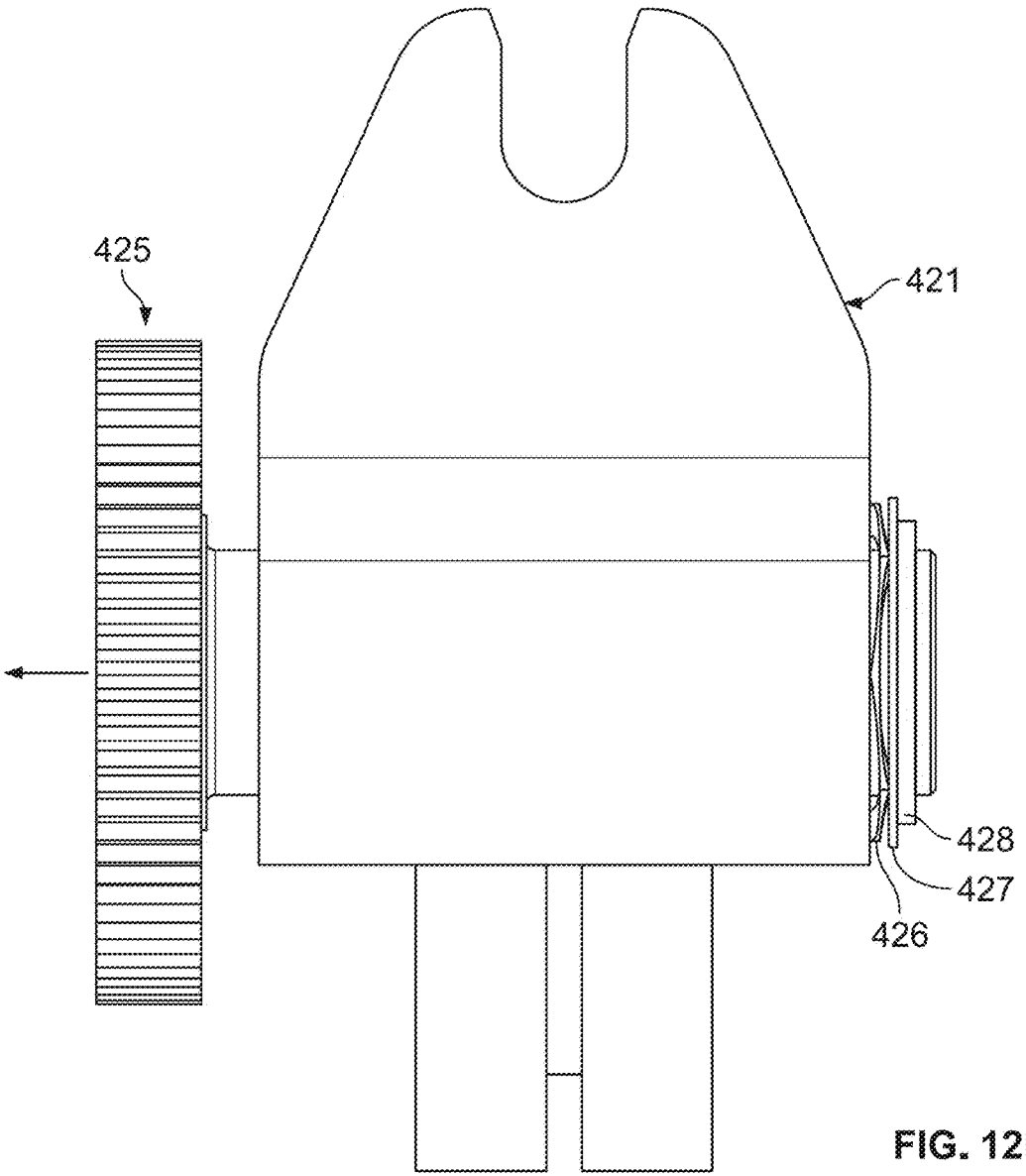

As best shown in FIGS. 10 and 12B, the height adjuster 425 is mounted to the support 421. Specifically, the body 425*b* of the height adjuster 425 is received in and extends through the height-adjuster-receiving bore 421*d* of the support 421 such that the free end of the body 425*b* (opposite the head 425*a*) projects from the height-adjuster-receiving bore 421*d*. The height-adjuster biasing element 426 and the washer 427 circumscribe the portion of the body 425*b* projecting from the height-adjuster-receiving bore 421*d*, and the retaining ring 428 is received in the groove 425*b*1. The height-adjuster biasing element 426 and the washer 427 are thus sandwiched between the body 421 and the retaining ring 428. The height adjuster 425 is rotationally positioned such that the height-adjuster locking pin 424 is received in the groove 425*a*4.

The height adjuster 425 is movable relative to the support 421 and the height-adjuster locking pin 424 in two ways. First, the height adjuster 425 is longitudinally movable relative to the support 421 and the height-adjuster locking pin 424 parallel to the axis $A_{425ab}$ between a locked position and an unlocked position. When the height adjuster 425 is in its locked position (FIG. 9A), the height-adjuster locking pin 424 is received in one of the locking-pin-receiving bores 425*a*5, 425*a*6, or 425*a*7, which prevents the height adjuster 425 from rotating. When the height adjuster 425 is in its unlocked position (FIG. 12B), the height-adjuster locking pin 424 is received in the groove 425*a*4 but removed from the locking-pin-receiving bores 425*a*5, 425*a*6, and 425*a*7, which enables the height adjuster 425 to rotate (as permitted by the groove 425*a*4). The height-adjuster biasing element 426 biases the height adjuster 425 to its locked position. To move the height adjuster 425 from its locked position to its unlocked position, an operator must pull the height adjuster 425 with enough force to overcome the biasing force of the height-adjuster biasing element 426.

Second, the height adjuster 425 is-when in its unlocked position-rotatable relative to the support 421 and the height-adjuster locking pin 424 among a first rotational position that corresponds to the first locking-pin-receiving bore 424*a*5, a second rotational position that corresponds to the second locking-pin-receiving bore 424*a*6, and a third rotational position that corresponds to the third locking-pin-receiving bore 424*a*7. Specifically, when the height adjuster 425 is in its first rotational position, the height-adjuster locking pin 424 is received in (when the height adjuster 425 is in its locked position) the first locking-pin-receiving bore 425*a*5 or in front of (when the height adjuster 425 is in its unlocked position) the first locking-pin-receiving bore 425*a*5. When the height adjuster 425 is in its second rotational position, the height-adjuster locking pin 424 is received in (when the height adjuster 425 is in its locked position) the second locking-pin-receiving bore 425*a*6 or in front of (when the height adjuster 425 is in its unlocked position) the second locking-pin-receiving bore 425*a*6. When the height adjuster 425 is in its third rotational position, the height-adjuster locking pin 424 is received in (when the height adjuster 425 is in its locked position) the third locking-pin-receiving bore 425*a*7 or in front of (when the height adjuster 425 is in its unlocked position) the third locking-pin-receiving bore 425*a*7. As described below, the rotational position of the height adjuster 425 controls the height of the counter roller 422 above the feed wheel 210.

Figure 12C:
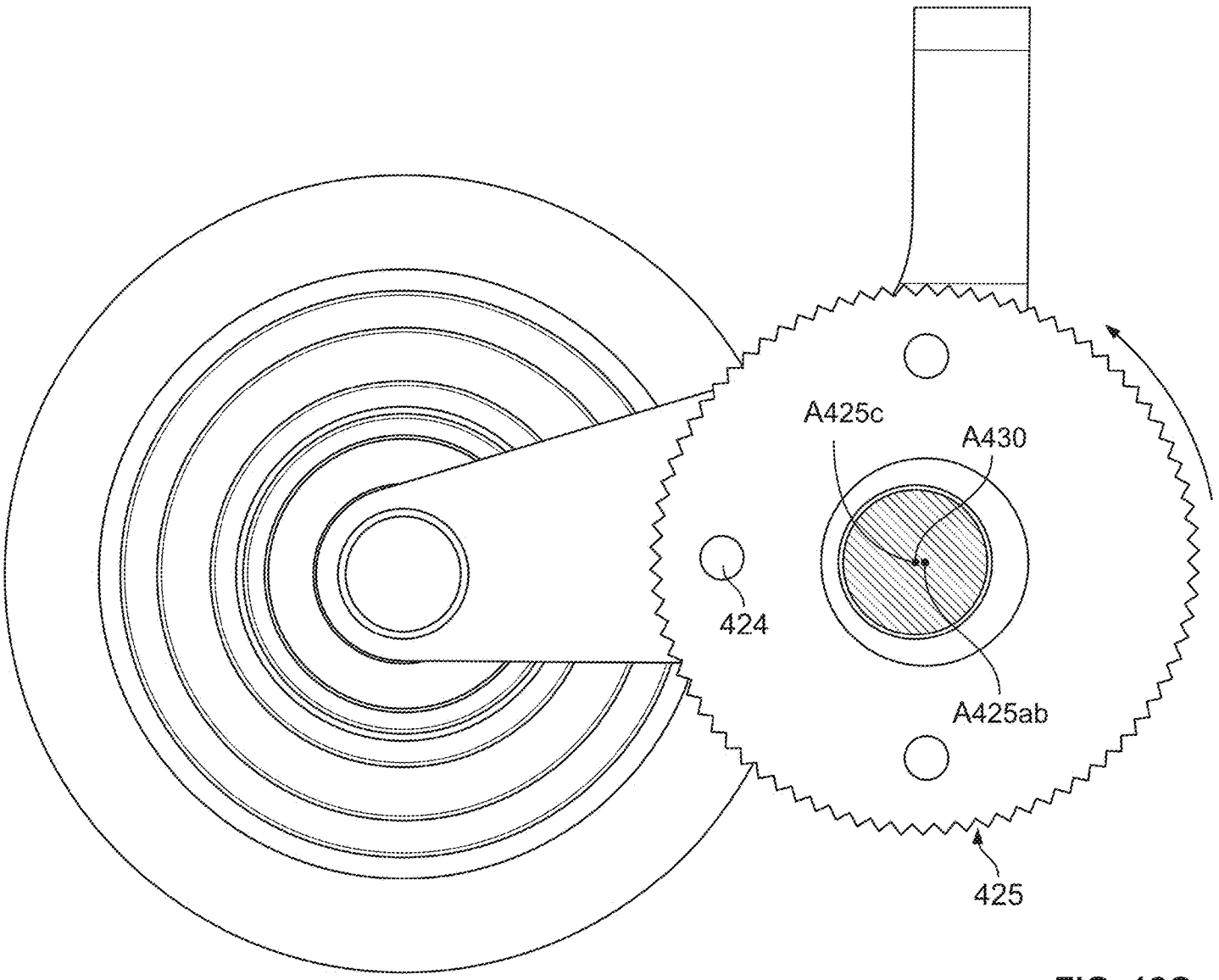

FIGS. 12A-12C show movement of the height adjuster 425 from its first rotational position to its second rotational position. As shown in FIG. 12A, initially the height adjuster 425 is in its locked position and its first rotational position such that the height-adjuster locking pin 424 is received in the first locking-pin-receiving bore 425*a*5. To rotate the height adjuster 425 to its second rotational position, an operator must first move the height adjuster 425 to its unlocked position. To do so, as shown in FIG. 12B, the operator pulls the head 425*a* away from the support 421, which compresses the height-adjuster biasing element 426 and removes the height-adjuster locking pin 424 from the first locking-pin-receiving bore 425*a*5 of the head 425*a*. This frees the height adjuster 425 to rotate. As shown in FIG. 12C, the operator rotates the height adjuster 425 to its second rotational position and releases the height adjuster 425. When this occurs, the height-adjuster biasing element 426 forces the height adjuster back to its locked position, which causes the height-adjuster locking pin 424 to enter the second locking-pin-receiving bore 425*a*6, thereby locking the height adjuster 425 against rotation.

The counter-roller assembly 420 is mounted to the housing 405 via the counter-roller-assembly mounting pin 430. Specifically, the counter-roller-assembly mounting pin 430 is received in and extends through the mounting-pin-receiving bore 425*c* of the height adjuster 425. The ends of the counter-roller-assembly mounting pin 430 are supported by the housing 405. As shown in FIG. 12A, the counter-roller-assembly mounting pin 430 has a rotational axis $A_{430}$ that is coaxial with the axis $A_{425c}$. Once mounted, the counter-roller assembly 420 is rotatable relative to the remaining components of the upper strap-guiding assembly 400 and relative to the feed wheel 210 about the counter-roller-mounting pin 430. And once mounted, the strap-engaging surfaces 422*a* and 422*b* of the counter roller 422 extend into the first and second counter-roller-receiving openings 410*a* and 410*b*, respectively, such that these surfaces can engage the strap (when the strap is received in the strap channel) and force the strap (via the biasing assembly 440, described below) against the feed wheel 210 to ensure proper feeding and retraction.

Figure 9A:
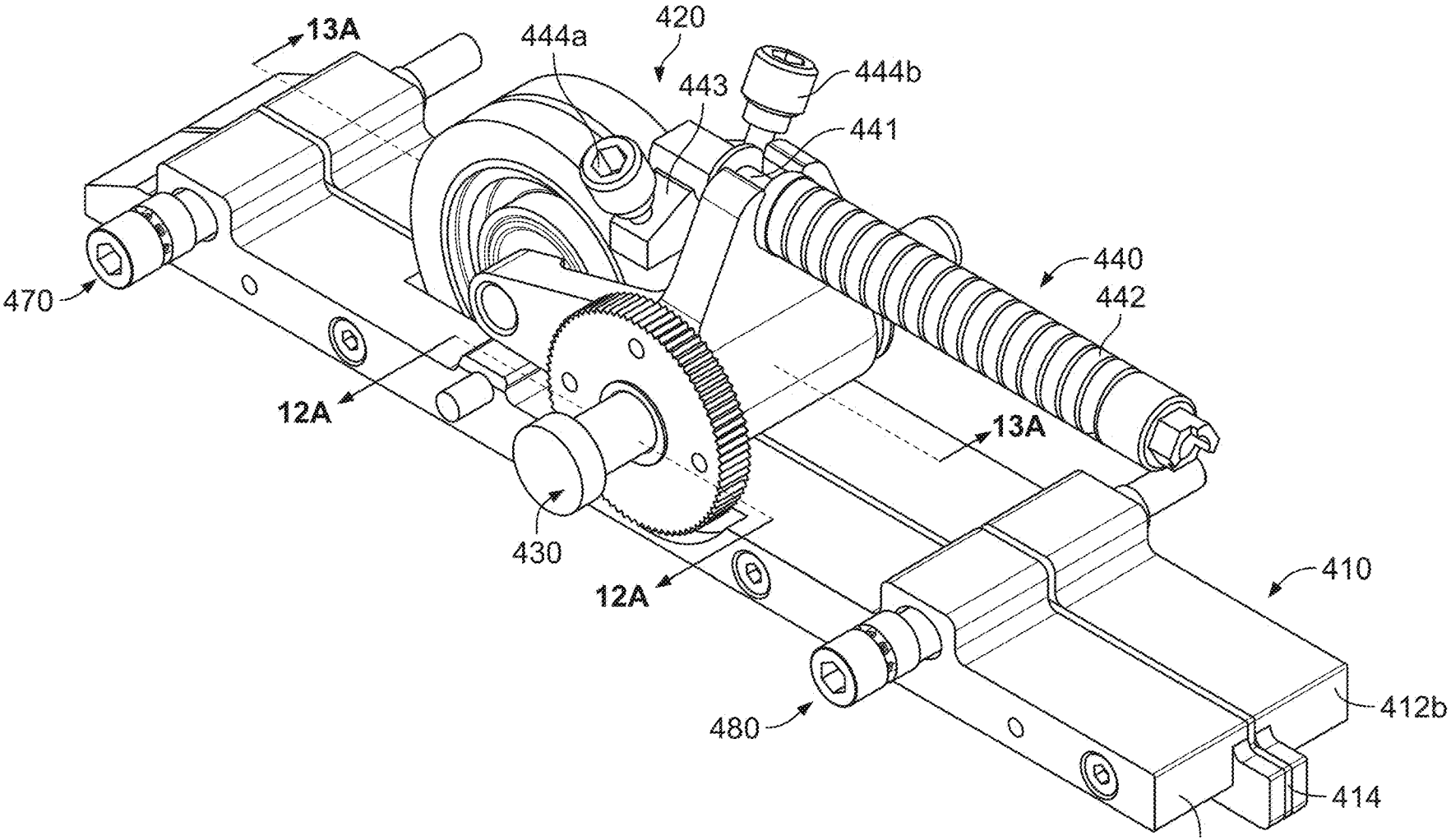
FIGS. 9A and 9B are perspective views of the upper strap-guiding assembly of the strap-feeding assembly of FIG. 2 with certain components removed.
Figure 9B:
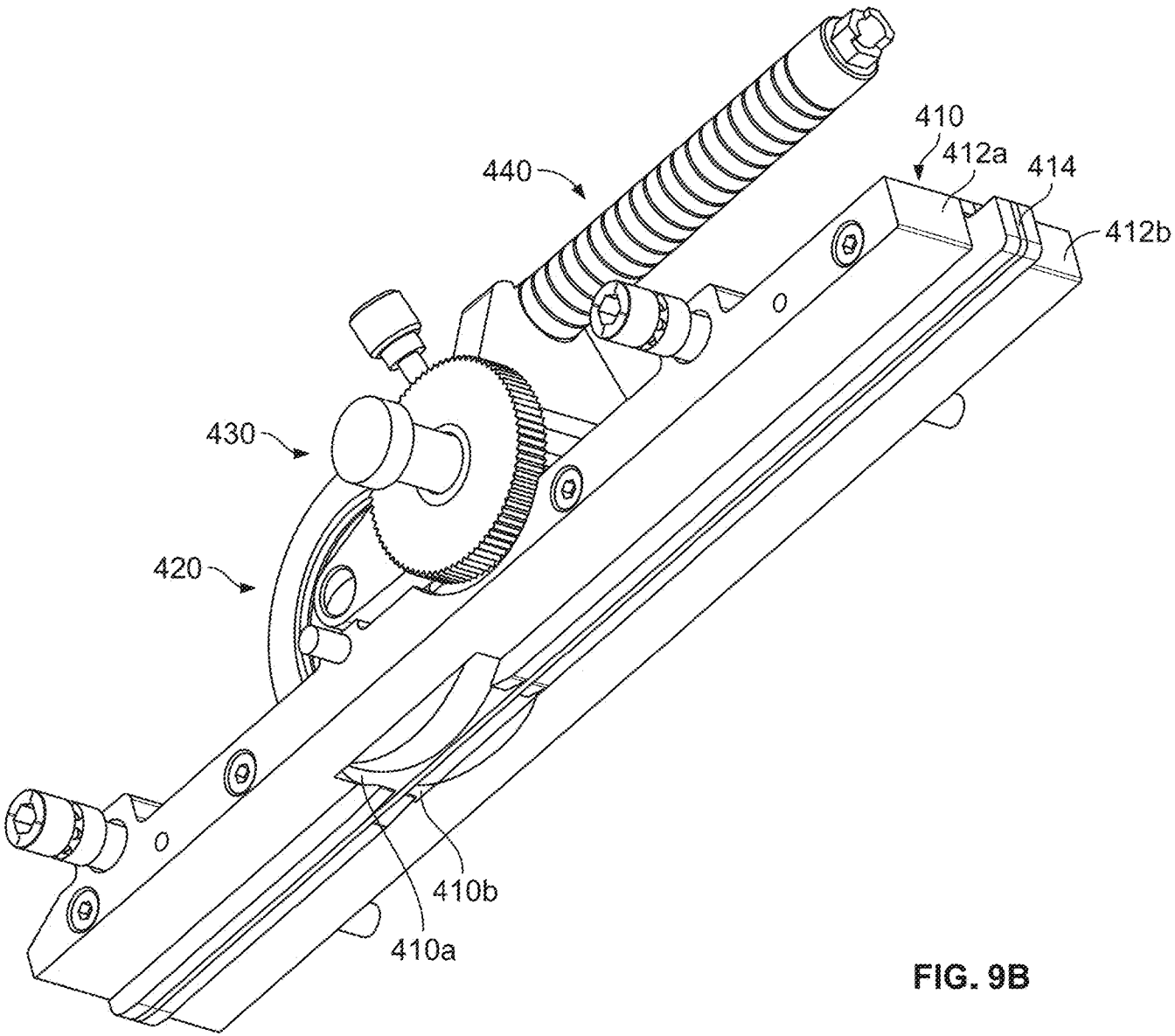

The biasing assembly 440, best shown in FIG. 9A, includes a rod 441, a counter-roller-assembly biasing element 442, a rod support 443, and adjusters 444*a* and 444*b*. A first end (not labeled) of the rod 441 is supported in the housing 405, and a second opposite end (not labeled) of the rod 441 is supported by the rod support 443. The rod support 443 is mounted to the housing 405 via the adjusters 444*a* and 444*b*, which may be manipulated (e.g., rotated one way or the other) to change the distance between the rod support 443 and the housing 405, which changes the distance between the counter-roller assembly 420 (and therefore the counter roller 422) and the feed wheel 210. Part of the rod 441 is received in a cutout defined in the biasing-assembly-engagement arm 421*a* of the support 421 of the counter-roller assembly 420. The counter-roller-assembly biasing element 442—here a compression spring—circumscribes the portion of the rod 441 that extends between the first end of the rod and the support 421. The biasing assembly 440 (and in particular the counter-roller-assembly biasing element 442) biases the counter-roller assembly 420 toward the feed wheel 210.

Figure 13A:
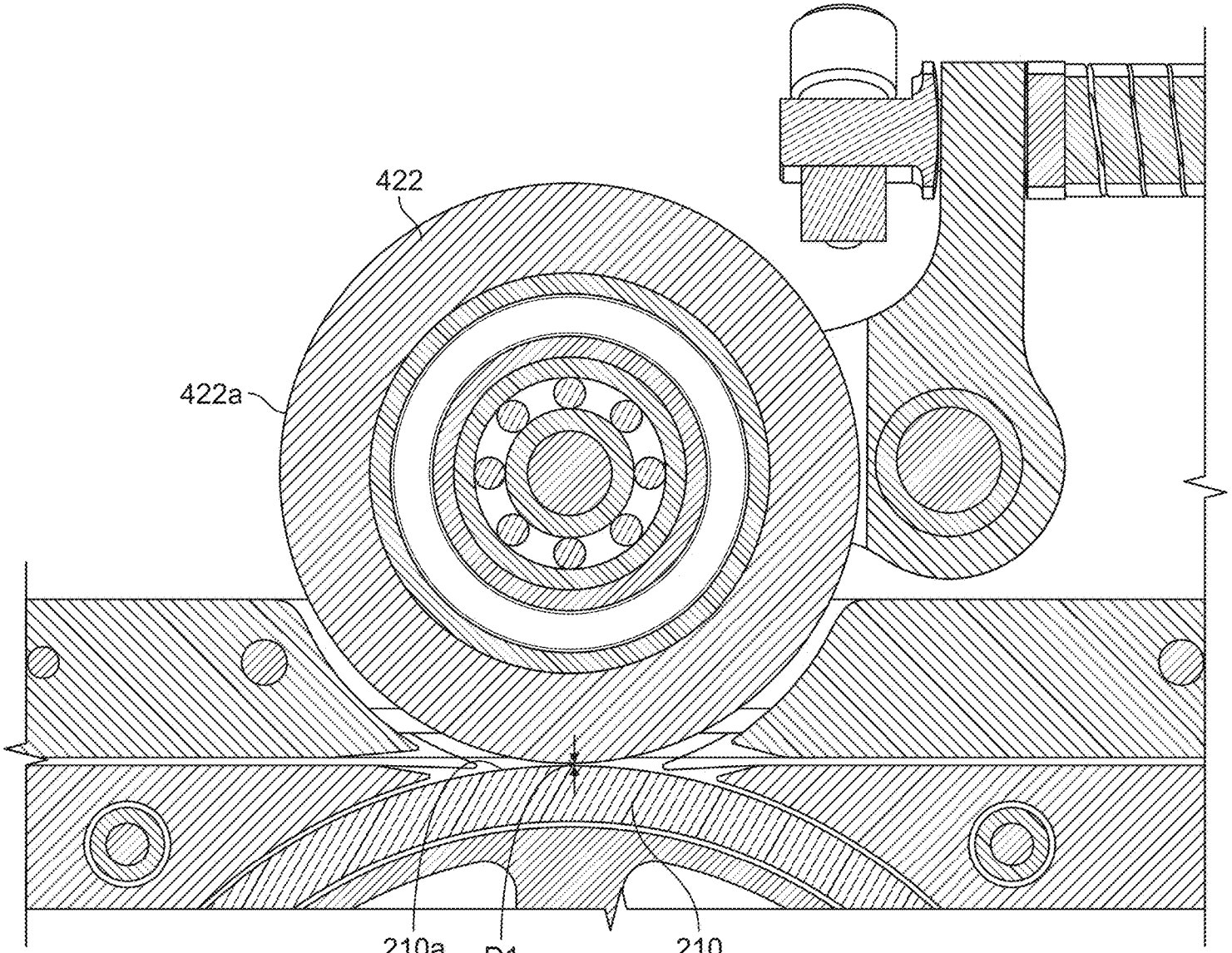
FIG. 13A is a cross-sectional side view of part of the strap-feeding assembly of FIG. 2 taken along line 13A-13A of FIG. 9A and showing the distance between the counter roller of the counter-roller assembly and the feed wheel when the height adjuster of the counter-roller assembly is in its first rotational position.
Figure 13B:
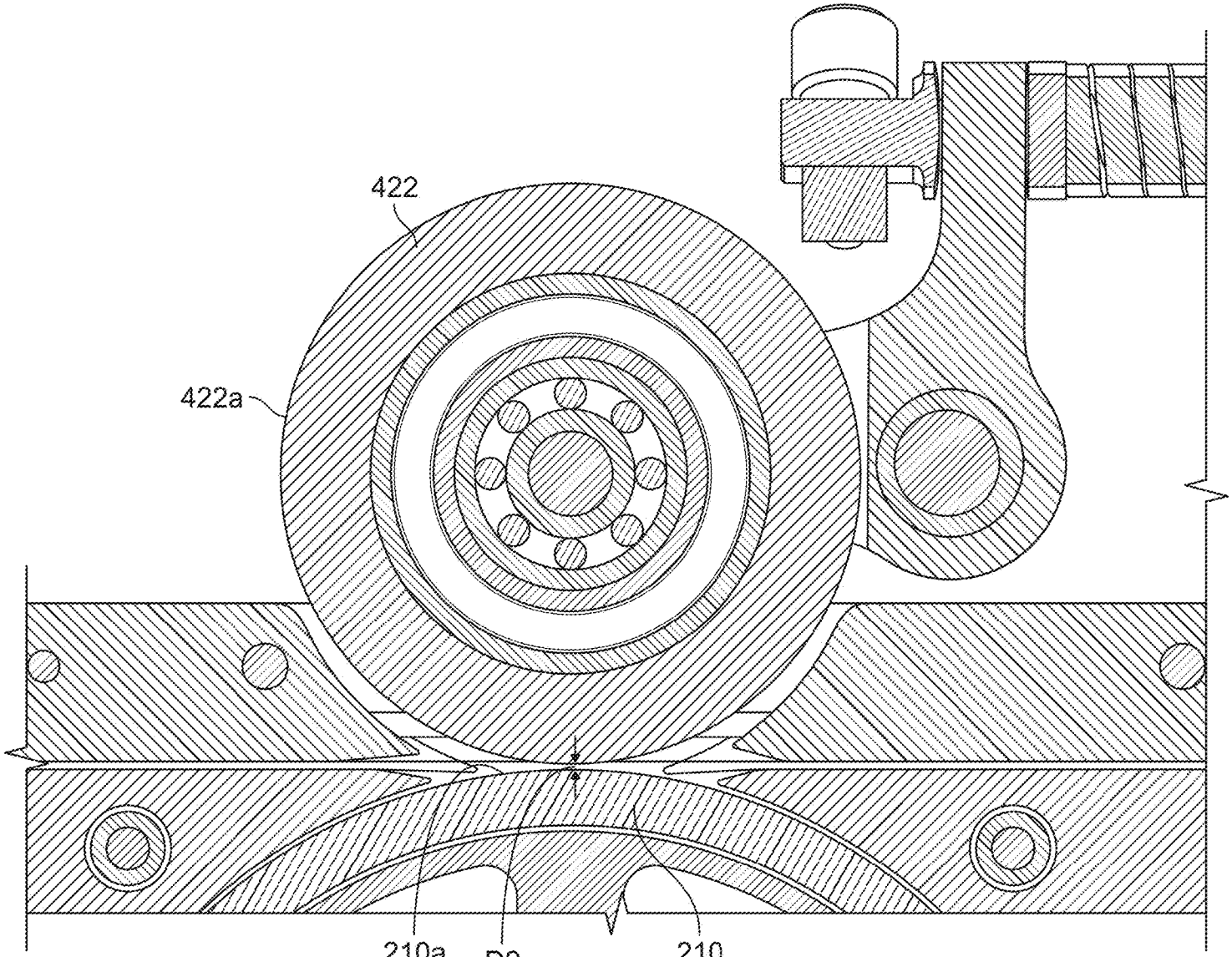
FIG. 13B is similar to FIG. 13A but shows the distance between the counter roller of the counter-roller assembly and the feed wheel when the height adjuster of the counter-roller assembly is in its second rotational position.
Figure 13C:
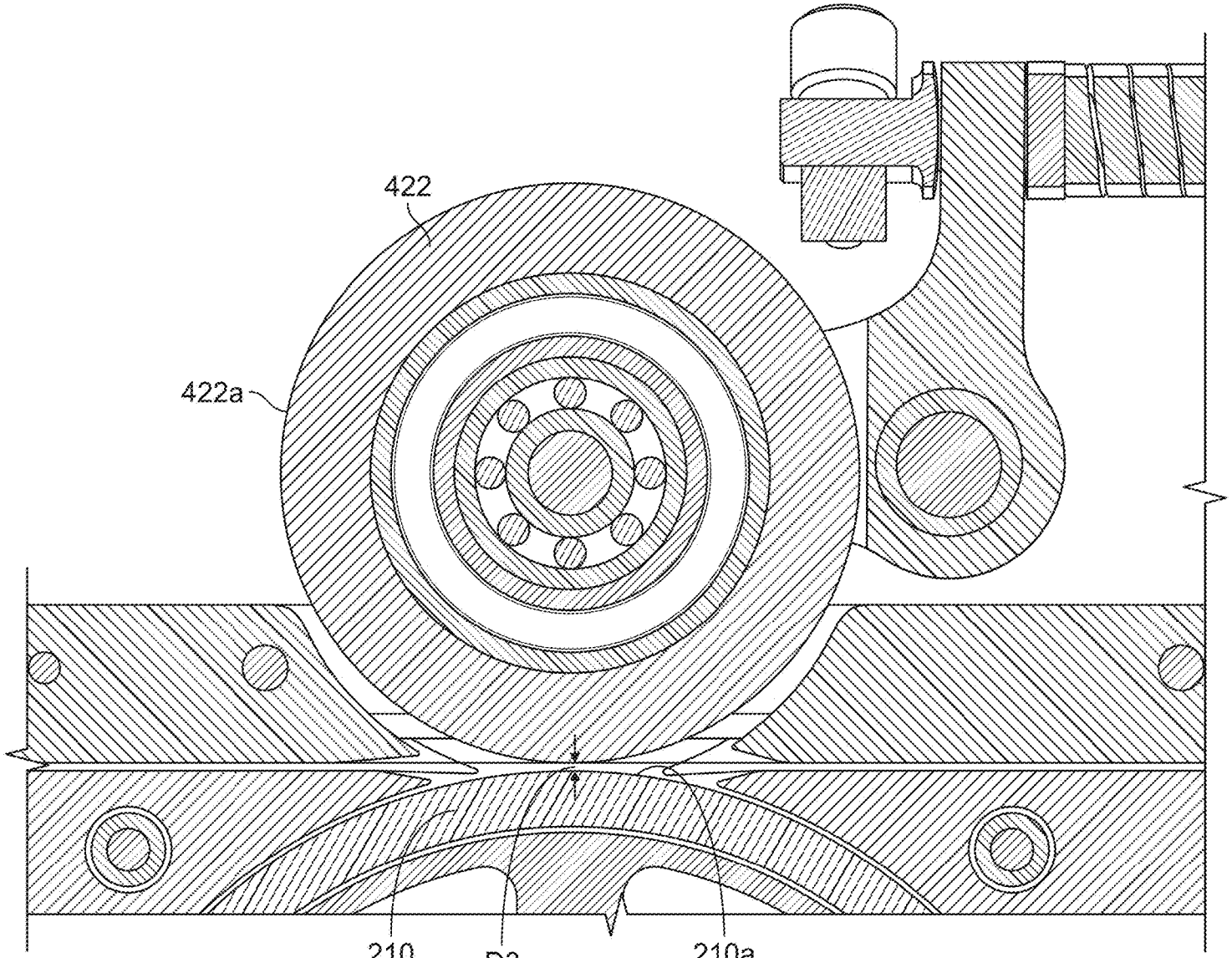
FIG. 13C is similar to FIG. 13A but shows the distance between the counter roller of the counter-roller assembly and the feed wheel when the height adjuster of the counter-roller assembly is in its third rotational position.

The rotational position of the height adjuster 425 determines the distance between the strap-engaging surfaces 422*a* and 422*b* of the counter roller 422 and the strap-engaging surfaces 210*a* and 210*b* of the feed wheel 210. Specifically, as shown in FIG. 13A, when the height adjuster 425 is in its first rotational position, the counter roller 422 is in a first position in which a first distance D1 separates the strap-engaging surfaces 422*a* and 422*b* of the counter roller 422 and the strap-engaging surfaces 210*a* and 210*b* of the feed wheel 210. As shown in FIG. 13B, rotating the height adjuster 425 from its first rotational position to its second rotational position raises the counter roller 422 (due to the offsetting axes $A_{425ab}$ and $A_{425c}$) to a second position in which a second distance D2 greater than the first distance separates the strap-engaging surfaces 422*a* and 422*b* of the counter roller 422 and the strap-engaging surfaces 210*a* and 210*b*. As shown in FIG. 13C, rotating the height adjuster 425 from its second rotational position to its third rotational position raises the counter roller 422 (due to the offsetting axes $A_{425ab}$ and $A_{425c}$) to a third portion in which a third distance D3 greater than the second distance separates the strap-engaging surfaces 422*a* and 422*b* of the counter roller 422 and the strap-engaging surfaces 210*a* and 210*b* of the feed wheel 210. The height adjuster 425 is therefore operably connected to the counter roller 422 to move the counter roller 422 toward and away from the feed wheel 210.

In operation, strap is received in an inlet IN (FIG. 7A) of the strap channel SC defined by the lower strap-guiding assembly 300 and the strap-channel cover 410 of the upper strap-guiding assembly 400 and directed to a nip (not labeled) between the feed wheel 210 and the counter roller 422. The biasing assembly 440 ensures the counter roller 422 presses the strap against the feed wheel 210. The actuator 250 then drives the feed wheel 210, which moves the strap through the remainder of the strap channel SC, exiting an outlet OUT (FIG. 2) of the strap channel SC defined by the lower strap-guiding assembly 300 and the strap-channel cover 410 of the upper strap-guiding assembly 400, through the guides and the tensioning and scaling assemblies, and into and around the strap chute CH. After the sealing assembly grips the leading end of the strap, the actuator drives the feed wheel 210 in the reverse direction to retract the strap from the strap chute CH and onto the load L.

The strap feeder improves upon prior art strap feeders because it enables an operator to quickly and easily (and in certain embodiments, toollessly) adjust the width of the strap channel, the height of the strap channel, and the distance between the counter roller and the feed wheel to accommodate straps of different widths and/or thicknesses. Specifically, and as described in more detail above, by simply manipulating the strap-channel-width adjusters, the eccentric mounting pins, and the height adjuster, the operator can ensure that these components are in the optimal position for the particular strap being used.

In other embodiments, the lower strap-guiding assembly includes only one movable outer guide member that (along with another stationary outer guide member and/or the strap-guiding-assembly frame) partially defines the strap channel. In this embodiment, rotation of the strap-channel-width adjusters causes the movable outer guide member to move as described above.

In other embodiments, the lower strap-guiding assembly includes only one strap-channel-width adjuster or more than one strap-channel-width adjuster.

In other embodiments, the strap-feeding assembly comprises an actuator operably connected to the strap-channel width adjuster (or to the outer guide member) and configured to manipulate the strap-channel width adjuster to move the outer guide member. In further embodiments, the strap-channel width adjuster comprises an actuator directly connected to the outer guide member and configured to move the outer guide member.

In various embodiments, the strap-feeding assembly includes only one of: (1) the lower strap-guiding assembly including one or more outer guide members movable to vary the width of the strap channel; and (2) the upper strap-guiding assembly including the height adjuster manipulatable to vary the distance between the counter roller and the feed wheel. In certain embodiments, one or more of the other assemblies (such as the strap-tensioning assembly and/or the strap-sealing assembly) of the strapping machine include the lower strap-guiding assembly and/or the upper strap-guiding assembly.

The invention claimed is:

1. A strap-feeding assembly comprising:

a strap-feeding-assembly frame comprising first and second strap-guiding-assembly mounts; and a strap-guiding assembly removably mountable to the strap-feeding-assembly frame and comprising:

a strap-guiding-assembly frame defining a mounting opening sized to receive the first strap-guiding-assembly mount and comprising a strap-guiding-assembly retainer; and a guide member mounted to the strap-guiding-assembly frame and at least partially defining a strap channel, wherein the first and second strap-guiding-assembly mounts are positioned such that the strap-guiding assembly is mounted to the strap-feeding-assembly frame and in an operational position when: (1) the first strap-guiding-assembly mount is received in the mounting opening of the strap-guiding-assembly frame; and (2) the strap-guiding-assembly retainer lockingly engages the second strap-guiding-assembly mount.

2. The strap-feeding assembly of claim 1, wherein when the strap-guiding assembly is mounted to the strap-feeding-assembly frame and in its operational position, the strap-guiding-assembly retainer resists movement of the strap-guiding assembly away from its operational position.

3. The strap-feeding assembly of claim 2, wherein the first strap-guiding-assembly mount comprises a first mounting pin such that, when the first mounting pin is received in the mounting opening of the strap-guiding-assembly frame, the strap-guiding assembly is rotatable about the first mounting pin into and out of the operational position.

4. The strap-feeding assembly of claim 3, wherein the strap-guiding-assembly retainer comprises a retainer housing defining a bore, a nose captively received in the bore, and a spring biasing the nose toward an opening of the bore such that part of the nose projects from the bore.

5. The strap-feeding assembly of claim 4, wherein when the strap-guiding assembly is mounted to the strap-feeding-assembly frame and in its operational position, the nose of the strap-guiding-assembly retainer engages the second strap-guiding-assembly mount.

6. The strap-feeding assembly of claim 5, wherein rotation of the strap-guiding assembly away from its operational position causes the nose of the strap-guiding-assembly retainer to move further into the bore.

7. The strap-feeding assembly of claim 5, wherein the second strap-guiding assembly mount defines an opening sized to receive part of the nose of the strap-guiding-assembly retainer when the strap-guiding assembly is in its operational position.

8. The strap-feeding assembly of claim 3, wherein the strap-feeding-assembly frame comprises spaced-apart first and second frame members and a support member extending between the first and second frame members, wherein the strap-guiding assembly is between the first and second frame members and supported by the support member when in its operational position.

9. The strap-feeding assembly of claim 8, wherein the second strap-guiding-assembly mount comprises a second mounting pin.

10. The strap-feeding assembly of claim 9, wherein the support member is mounted to the first frame member via the second mounting pin.

11. The strap-feeding assembly of claim 10, wherein the strap-guiding-assembly retainer comprises a retainer housing defining a bore, a nose captively received in the bore, and a spring biasing the nose toward an opening of the bore such that part of the nose projects from the bore.

12. The strap-feeding assembly of claim 11, wherein when the strap-guiding assembly is mounted to the strap-feeding-assembly frame and in its operational position, the nose of the strap-guiding-assembly retainer engages the second mounting pin.

13. The strap-feeding assembly of claim 12, wherein rotation of the strap-guiding assembly away from its operational position causes the nose of the strap-guiding-assembly retainer to move further into the bore.

14. The strap-feeding assembly of claim 12, wherein the second strap-guiding assembly mount defines an opening sized to receive part of the nose of the strap-guiding-assembly retainer when the strap-guiding assembly is in its operational position.

15. The strap-feeding assembly of claim 12, wherein the support member defines an opening therethrough, wherein part of the strap-guiding-assembly frame comprising the strap-guiding-assembly retainer extends into the opening.

16. The strap-feeding assembly of claim 1, wherein after the strap-guiding assembly is mounted to the strap-feeding-assembly frame and in the operational position, the strap-guiding assembly is removable from the strap-feeding-assembly frame without the use of tools.

* * * * *